US009706807B2

(12) United States Patent
Abbondanza et al.

(10) Patent No.: US 9,706,807 B2
(45) Date of Patent: Jul. 18, 2017

(54) HEADGEAR SYSTEM WITH IMPACT REDUCTION FEATURE

(71) Applicants: Dewey W Abbondanza, Pittsburgh, PA (US); Dean Abbondanza, Pittsburgh, PA (US)

(72) Inventors: Dewey W Abbondanza, Pittsburgh, PA (US); Dean Abbondanza, Pittsburgh, PA (US)

(73) Assignee: Biosport Athletechs, LLC, Pittsburgh, PA (US)

( * ) Notice: Subject to any disclaimer, the term of this patent is extended or adjusted under 35 U.S.C. 154(b) by 40 days.

(21) Appl. No.: 14/804,871

(22) Filed: Jul. 21, 2015

(65) Prior Publication Data

US 2017/0020223 A1 Jan. 26, 2017

(51) Int. Cl.

| | |
|---|---|
| ***A63B 71/10*** | (2006.01) |
| ***A42B 3/20*** | (2006.01) |
| ***A42B 3/06*** | (2006.01) |

(52) U.S. Cl.

CPC ..... *A42B 3/20* (2013.01); *A42B 3/069* (2013.01); *A63B 71/10* (2013.01)

(58) Field of Classification Search

CPC ..... A42B 3/222; A42B 3/06; A63B 71/10
USPC ..... 2/424, 410, 425, 412, 909
See application file for complete search history.

(56) References Cited

U.S. PATENT DOCUMENTS

| | | | | |
|---|---|---|---|---|
| 5,103,513 | A | 4/1992 | King | |
| 5,502,901 | A | 4/1996 | Brown | |
| 8,191,180 | B2 | 6/2012 | Berry | |
| 2007/0294916 | A1 | 12/2007 | Park | |
| 2010/0101111 | A1 | 4/2010 | McDonnell | |
| 2012/0000008 | A1 | 1/2012 | Baldackin | |
| 2012/0048663 | A1 | 3/2012 | McDonnell | |
| 2014/0215693 | A1 | 8/2014 | O'Gara | |
| 2014/0259308 | A1 * | 9/2014 | Moss | A42B 3/0406 2/410 |

OTHER PUBLICATIONS

Rowson, Steven; Development of the STAR Evaluation System for Football Helmets: Integrating Player Head Impact Exposure and Risk Concussion; Annals of Biomedical Engineering, Aug. 2011, pp. 2130-2140; vol. 39, No. 8; Biomedical Engineering Society, Landover, Maryland, US, 11 pages.

* cited by examiner

*Primary Examiner* — Tejash Patel
(74) *Attorney, Agent, or Firm* — Metz Lewis Brodman Must O'Keefe LLC

(57) ABSTRACT

A headgear system with first and second helmets is provided. The first helmet has a frontal bone section that covers a frontal bone of a wearer of the first helmet, and a first magnet component that is located at the frontal bone section of the first helmet. The first magnet component extends at least 90 degrees around the central axis of the first helmet. The second helmet has a frontal bone section that covers a frontal bone of the wearer, and a second magnet component is located at the frontal bone section of the second helmet. The magnet forces of the first and second magnet components repel one another when the first and second magnet components are located proximate to one another to help reduce force onto the head from impact.

45 Claims, 17 Drawing Sheets

FIGURE: MAX IMPACT OF HELMET 1 (LINEAR ACCELERATION) IN Gs vs. SPEED–COMPARISON OF THE HEAD

FIGURE: MAX IMPACT OF EXTERNAL HELMET 1 (LINEAR ACCELERATION) IN Gs vs. SPEED–COMPARISON OF THE HEAD

FIGURE: GYROSCOPE–COMPARISON OF THE HEAD

FIGURE: HELMET TWIST OF HELMET 1 PRE IMPACT IN DEGREES vs. SPEED

HEADGEAR SYSTEM WITH IMPACT REDUCTION FEATURE

FIELD OF THE INVENTION

The present invention relates generally to a headgear system that can be used in sport applications for reducing impact onto the head of the participants. More specifically, the present invention relates to protective devices used when playing sports that include magnets that function to repel one another such that head gear worn by two different participants repel to reduce impact force onto the head of the participant when the two pieces of headgear collide with one another.

BACKGROUND

Today in contact sports, and more specifically football, hockey, lacrosse and other activities in which body-on-body contact is likely, there is great concern and need to reduce or prevent head and neck injuries. Athletes participating in contact sports and especially football players are exposed to countless impacts resulting in Traumatic Brain Injuries (TBI). This occurs across all age groups and at all levels of play, from pre-teen amateur up through college and professional. It has been estimated that there are upwards of 3,000,000 concussions every year due to TBI. Other studies have estimated the number of concussions sustained in sports each year is between 1,600,000 and 3,800,000.

One currently existing technology used in football helmets is a Head Impact Telemetry (HIT) system that measures the helmet accelerations of players while they are on the field. This HIT system is limited in that it is incapable of measuring acceleration of a player's head, which is different than the acceleration of a player's helmet. Research has shown that the HIT system overestimates Hybrid III peak linear accelerations by 0.9% and underestimates rotational acceleration by 6.1%.

Present day football helmets have made considerable advancement with the adoption of safer equipment. These devices have been improved through the study of linear and rotational acceleration forces and how they are imparted through the helmet to the head and neck resulting from direct impact. The helmet, specifically skull, occipital, and mandible shell coverage, together with an interior padding systems, face guards, and both low and high point harnessing have been advanced to reduce the risk of head (concussion) and neck injuries. This equipment improvement, combined with proper instruction and technique, has reduced the incidence of such injury.

The majority of these injuries can be directly correlated to high speed linear and rotational impact forces. In spite of the new advancements, however, head, neck and other soft tissue/skeletal trauma resulting from helmet-helmet, helmet-shoulder, and helmet-leg contact is still prevalent. The unpredictability of 22 players in a full speed, full contact contest, introduces countless angles and variables of body part interaction that are difficult to account for even with today's current helmet/equipment technology. It is for these reasons that head, neck, and other injuries continue to plague these contact sports.

Attempts to alleviate these injuries have been proposed where apparatuses are created connecting helmet and shoulder pads and attaching braces that would restrict helmet movement. Unfortunately, these type of helmet restrictors and interconnectors with shoulder pads also severely interfere with play execution as a result of the restriction of head movement. Other types of equipment devices comprising cushion-like collars surrounding the base of the helmet or even the neck have also proven to be uncomfortable and interfering for players. It would seem that all these conventional approaches to equipment modification suffer because of their starting point: restricting player agility, mobility, movement from the very beginning of play execution.

Present day helmet/equipment technology views the helmet as an integrated protective apparatus; comprised of the plastic outer shell, interior padding/shock absorbing system, chin restraint, and face guard. All of these components integrate into one protective apparatus designed to absorb linear and angular collision forces resulting from direct, full speed body collision. The design intent is to reduce trauma imparted to the head and neck.

Additionally, several devices and methodologies have been suggested to reduce impact beyond strength of materials and cushioning. Berry, U.S. Pat. No. 8,191,180, describes the use of a restrictor system which is designed to reduce hyperextension of the neck and head. The helmet and shoulder pads of a typical football uniform are equipped with a series of magnets of similar polarity, creating a cooperative force which resists the relative movement of the helmet and shoulder pads toward each other. The placement of the magnets, on the back of the helmet and pad openings, restricts the backward movement of the helmet and head toward the shoulder pads. This permits normal side to side movement while reducing hyperextension of the neck in the rearward position. These and other systems are typically directed toward the reduction of impact shock within a device, such as a shoe, when striking the ground. The devices are designed to reduce the impact force of the load within the device, acting more as a cushion than a device for reducing the impact force itself.

Another helmet system disclosed in O'Gara, United States Patent Publication No. 2014/0215693 employs magnets in different helmets that repel one another to reduce velocity and deflect the helmets during helmet collisions. The magnets employed had a length of seven inches and extend at most 22.2% around a central axis of the helmet. The surfaces of the helmets did not include any protrusions that extend beyond the face guards, and the magnets were not encased or otherwise contained on the helmet and subject to removal or falling from the helmet when damaged. There remains a need, therefore, for a system or device which actually serves to reduce the impact force, rather than merely absorb the energy without imparting it to the body part contained in the equipment, and for such a system to function properly to reduce concussions during play.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS. in which.

Figure 1:
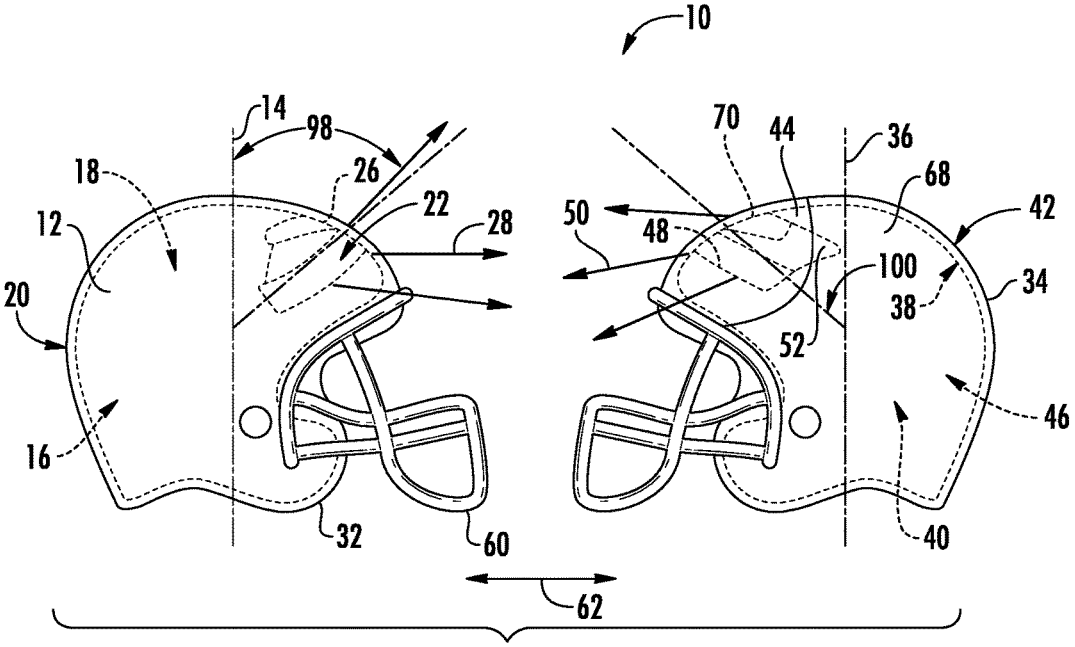
FIG. 1 is a side view of a head gear system in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a headgear system 10 that takes a different approach to reducing head, neck and other bodily injuries as a result of high speed player-player collision. The impact reduction technology employs a unique "direct impact avoidance" system. The impact reduction system integrates a series of magnets into helmets such that all of the players on the field are presenting the same polarity to each other, with the resultant repelling effects on each other. This headgear system 10 may arrange magnet components 26 and 48 into inserts which can be easily retrofitted into existing equipment or molded in place. When incorporated, the headgear system 10 causes helmet 12, 34 contact between opposing players to slightly veer centerline impact collision points, thus reducing the maximum impact collision forces to both players. The headgear system 10 seeks to provide a design whose intent is to limit maximum helmet linear and rotational accelerations to 80 g or less. Play execution is not affected because the redirecting repulsive forces of the magnet components 26, 48 do not come into play until opposing players are close to making contact with each other. This has the potential to greatly reduce high speed impact collision trauma, which is attributed to the majority of head, neck, soft tissue and skeletal related injuries from full contact collision.

The most significant impact forces occur when there is direct-in-line helmet-to-helmet contact between two opposing players. In this circumstance, the analogy of a player charging head first into a wall would be applicable because all forces have to be absorbed, rather than redirected. The technology is dependent upon all contest participants being fully equipped with the magnetic equipment. However, in some instances fewer than all of the players on the field may have the magnetic equipment, but the headgear system 10 will not function to protect the players because the headgear system 10 operates on repelling forces between two different players making contact. The magnetic raw material origin, magnitude of charge, shape, grain orientation, mass and group configuration will be dependent upon the specific equipment.

The helmet 12 is not limited to football style helmets, and any helmet for use in sport or other impact producing activities may be similarly equipped. These include hockey, lacrosse, auto racing and the like. A series of magnet components 26, 48 with engineered grain axis orientation is arranged to provide a field of uniform polarity extending radially outwardly from the helmets 12, 34. The field may be uniform or non-uniform, with higher magnetic flux disposed in areas of high impact likelihood. Any type of magnetic material may be used such as neodymium magnetic material. The magnetic material making up the magnetic components 26, 48 may be affixed to the inner surface 16 of the helmet 12 or molded directly into the shell 32 of the helmet 12. The magnet components 26, 48 may be retrofit to existing equipment. The magnet component 26 is arranged to provide a flux field which is intended to interact with similar flux fields provided on other players' helmets 34.

The helmet-magnet shape, configuration and assembly may be designed to maximize impact deflection and force reduction to protect all four (4) quadrants of the brain—frontal crown, left, right and rear about the helmet 12. However, in some embodiments certain quadrants, for example the back, may not be protected with the magnet repulsion. In each embodiment, the magnetic fields are directed such that the outward polarity of all magnet components 26, 48 are the same. This will create a repelling force between each helmet 12, 34 that has a magnet component carried thereon. At the point of impact, the repelling forces will serve to reduce the impact force of direct linear impact by either direct repulsion, or redirecting the oncoming player to a non-linear impact. The displacement of each helmet 12, 34 from direct linear contact by a small amount will still serve to substantially lessen the actual forces imparted to the body part contained in the equipped device, such as the helmet/head. The magnet components 26, 48 may be located at the front of the helmets 12, 34 and not at any other portion of the helmets 12, 34 such that the back and top of the helmets are free from magnet components of any types.

The actual configuration of magnets components 26, 48 may be a plurality of small neodymium magnets of differing grade and/or size strategically located around the helmets 12, 34 or it may be a larger, single custom manufactured neodymium magnet of specific shape and dimension to be incorporated into the manufacturing of the helmets 12, 34. The strength of the magnets' repulsive forces are determined by the size and orientation of the magnet components 26, 48. The magnet components 26, 48 can be of any number and may be a permanent magnet in some exemplary embodiments. The magnet components 26, 48 may not be an electromagnet in some arrangements.

The first and second magnet components 26, 48 may have a strength of or equivalent to neodymium magnets N-35, N-38, N-40, N-42, N-45, N-48, N-52, N-54, or up to N-64. The strength may be at least N-48, at least N-52, at least N-54 in accordance with various embodiments. The strength of the first and second magnet components 26, 48 with respect to their max. energy product BH (max) may be at least 35.0 MGO, at least 38.0 MGO, at least 40.0 MGO, at least 42.0 MGO, at least 45.0 MGO, at least 48.0 MGO, at least 52.0 MGO, at least 54.0 MGO, or up to 64.0 MGO. The max. energy product BH (max) of the first and second magnet components 26, 48 may be from 40.0-50.0 MGO, from 50.0-60.0 MGO, or at least 60.0 MGO in accordance with various exemplary embodiments. The strength of the first and second magnet components 26, 48 measured with respect to their residual induction BR properties may be at least 11,000 Gauss, at least 12,200 Gauss, at least 12,500 Gauss, at least 12,800 Gauss, at least 13,200 Gauss, at least 13, 800 Gauss, at least 14,200 Gauss, at least 14,800 Gauss, from 12,000-13,000 Gauss, from 10,000-11,000 Gauss, from 11,000-12,000 Gauss, from 12,000-13,000 Gauss, from 13,000-14,000 Gauss, from 14,000-15,000 Gauss, from 15,000-16,000 Gauss, or from 16,000-17,000 Gauss in accordance with various exemplary embodiments.

FIG. 1 is a side view of a headgear system 10 in accordance with one exemplary embodiment. The headgear system 10 can include a number of helmets and a first helmet 12 and a second helmet 34 are illustrated. The headgear system 10 may in some embodiments include 22 helmets, 12 helmets, from 2-10 helmets, from 11-40 helmets, or up to 100 helmets. The helmet 12 has a central axis 14 that extends in the vertical direction and is centered with respect to a first shell 32 of the first helmet 12. The first shell 32 may be made of a variety of materials and may be a single component or may be made of multiple components. The first shell is typically a hard material that can withstand impact forces without breaking. Padding and liner may be located on the inner surface of the first shell 32 to likewise absorb impact forces, and to provide a proper fit and comfortability to the wearer 24 of the first helmet 12. A faceguard 60 is also included and can be attached to the first shell 32 to protect the face of the wearer 24 and to absorb impact forces.

The first helmet 12 includes a first magnet component 26 that is carried by the first shell 32. The first magnet component 26 may be located on an exterior surface 20 of the first helmet 12, on an inner surface 16 of the first helmet 12, or between the interior and exterior surfaces 18, 20. In some exemplary embodiments, the first magnet component 26 may be located at both the exterior surface 20 and the interior surface 18, and in yet further exemplary embodiments may be located in combinations at the inner surface 16, exterior surface 20, and between the interior and exterior surfaces 16, 20. The first magnet component 26 is located at a frontal bone section 22 of the first helmet 12. The frontal bone section 22 is located at the forward part of the first helmet 12 with respect to the central axis 14 so as to be located closer to the face guard 60 than the central axis 14. The frontal bone section 22 may be a portion of the first shell 32 that covers the frontal bone 76 of the wearer 24. The inner surface 16 of the first helmet 12 defines an interior 18 of the first helmet 12. The head of the wearer 24 is located in the interior 18 when donning the first helmet 12. The first magnet component 26 emits a first magnet force 28 in a direction away from the interior 18. Although it may be the case that some of the first magnet force 28 is directed towards the interior 18, it is to be understood that the majority of the first magnet force 28 is directed away from the interior 18 and thus is directed generally away from the first helmet 12. The first magnet component 26 may generate a pair of magnet forces, one being positive in polarity and the other being negative in polarity. The first magnet force 28 may be either one of the polarities generated by the first magnet component, and the other magnet force generated by the first magnet component 26 that is not illustrated may be directed generally towards the interior 18.

The headgear system 10 includes a second helmet 34 that is arranged in generally the same manner as the first helmet 12. In this regard, the second helmet 34 includes a central axis 36 that extends through an interior 40 of the second helmet 34 and is centered with respect to a second shell 68 of the second helmet 34. The second shell 68 may be arranged in a manner similar to that of the first shell 32 previously discussed. The second helmet 34 has a frontal bone section 44 that covers a frontal bone of the wearer 46 of the second helmet 34 when the second helmet 34 is worn. A second magnet component 48 is carried by the second helmet 34 and may be located on the exterior surface 42 of the second helmet 34, or may be located on an inner surface 38 of the second helmet 34. In other embodiments, the second magnet component 48 may be located on both the interior and exterior surfaces 38, 42, or may be located inside of the second shell 68 so as to be located on neither one of the inner or exterior surfaces 38, 42. As may be appreciated, any combination of placement of the second magnet component is possible on the second helmet 34 such that one or all of the second magnet component 48 may be located on any one of or combination of the inner surface 38, exterior surface 42, or within these two surfaces 38, 42.

The second magnet component 48 emits a second magnet force 50 that extends in a direction away from the interior 40 of the second helmet 34. As discussed with respect to the first magnet force 28, the second magnet force 50 may be either a positive or negative magnet force, and the other one of the positive or negative forces may extend inward to the interior 40. Further, although described as extending away from the interior 40, it is to be understood that some of the second magnet force 50 may in fact extend into and towards the interior 40, although the majority of the second magnet force 50 is directed away from the interior 40 and thus projects away from the second helmet 34 in the longitudinal direction 62.

When the helmets 12, 34 are brought together in a face-to-face manner the first magnet force 28 and the second magnet force 50 will be projected onto one another. The polarity of the first and second magnet forces 28, 50 is selected so that they will always repel one another and will not attract one another. The polarity of the first and second magnet forces 28, 50 may both be positive, or they may both be negative in accordance with certain exemplary embodiments. However, it is to be understood that the arrangement of the first and second magnet components 26, 48 is selected so that they repel one another when the two helmets 12, 34 contact one another in a face-to-face strike. The strength and arrangement of the first and second magnet components 26, 48 may be selected so that they are not strong enough and/or positioned to attract one another when the first helmet 12 strikes a different portion of the second helmet 34 such as the top, back, left side, or right side of the second helmet 34. Still further, magnetic dampening material may be located in strategic points on the first and second helmets 12, 34 to prevent any attraction between the first and second magnet components 26, 48. However, it is to be understood that in some exemplary embodiments the magnet components 26, 48 may be arranged and/or sized so that they do in fact attract one another in certain limited strike orientations between the two helmets 12, 34.

Figure 2:
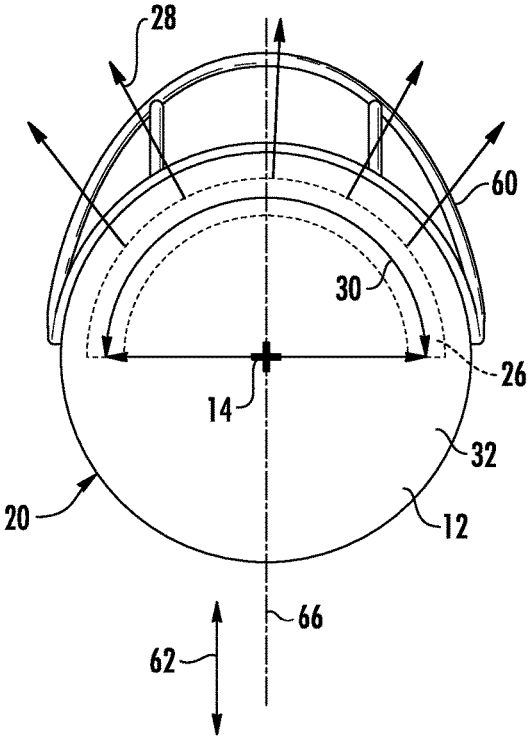
FIG. 2 is a top view of a helmet that carries a magnet component.

FIG. 2 is a top view of the first helmet 12 in accordance with one exemplary embodiment. The first helmet 12 includes the central axis 14 through which a longitudinal center line 66 of the first helmet 12 extends. The longitudinal center line 66 divides the first helmet 12 into a left half and a right half and this extends through the center of the first helmet 12. The longitudinal center line 66 also extends in the longitudinal direction 62 of the first helmet 12 that again is the direction of the first helmet 12 that extends from the central axis 14 to the face guard 60 in the forward direction. The first magnet component 26 is shown as having an extension 30 around the central axis 14. The extension 30 illustrated is 180°, although it is to be understood that other degrees of extension 30 are possible in accordance with other exemplary embodiments. For example, the extension 30 may be at least 90°, from 90°-120°, from 120° 480°, from 180°-270°, or up to 360° in accordance with various exemplary embodiments. The extension 30 may also be thought of as the arc length extension of the first magnet component 26 about the central axis 14. The first magnet component 26 may be arranged so as to be symmetrical about the longitudinal center line 66, or in other embodiments the first magnet component 26 may be asymmetrical with respect to the longitudinal center line 66.

Figure 3:
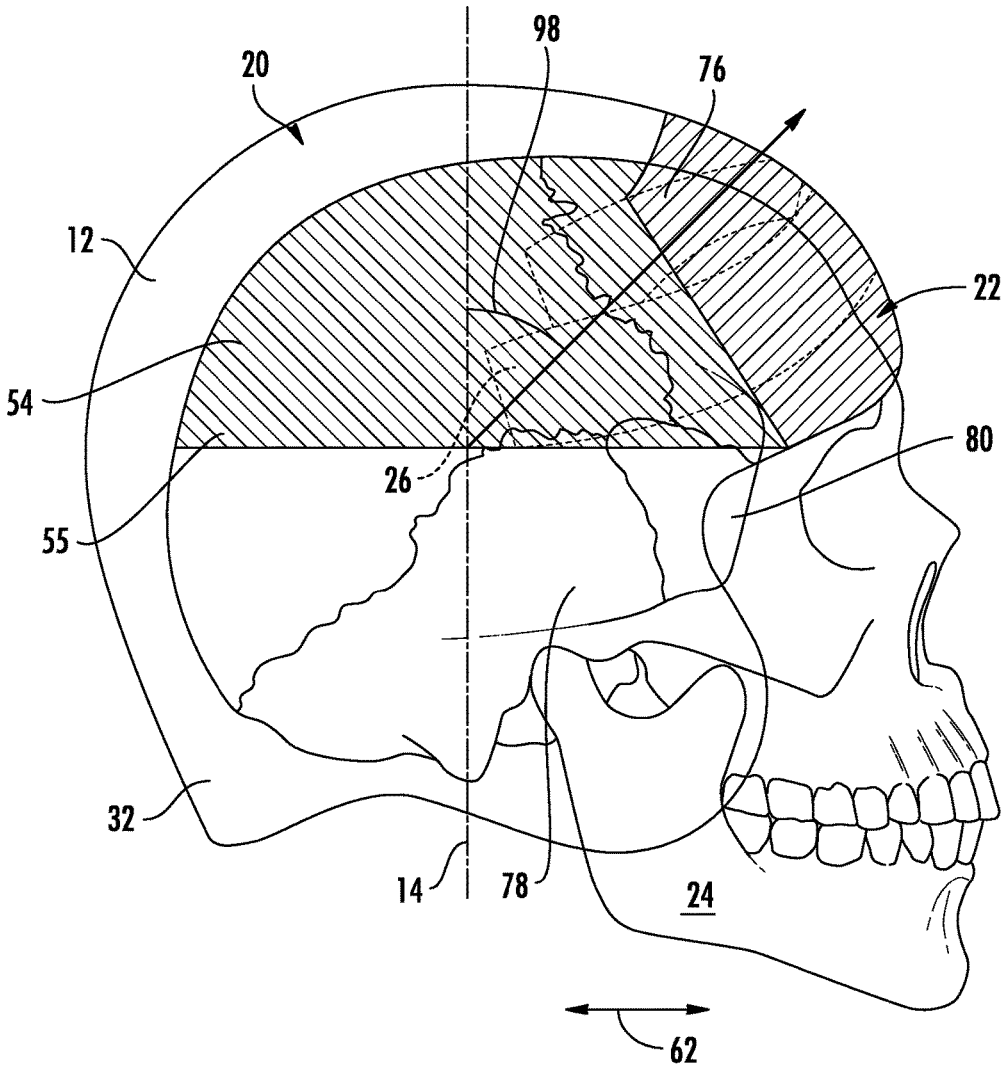
FIG. 3 is a side view of a skull of a wearer of the helmet.

With reference now to FIG. 3, a side view of the head of the wearer 24 is shown with the first shell 32 located thereon. The bones of the skull of the wearer 24 include a frontal bone 76 that is adjacent to a right parietal bone 55 and a right sphenoid bone 80. The first shell 32 may also cover a right temporal bone 78 of the skull of the wearer 24 that is adjacent to both the right parietal bone 55 and the right sphenoid bone 80. The first magnet component 26 is shown as carried by the first shell 32 and is located at a frontal bone section 22 of the first helmet 12 that covers the frontal bone 76. It is to be understood that the frontal bone section 22 need not cover the entire frontal bone 76 but may cover a majority of the frontal bone 76 in accordance with various exemplary embodiments. Likewise, the first magnet component 26 may be located on the entire frontal bone section 22, may be located on a majority of the frontal bone section 22, or may be located on less than the majority of the frontal bone section 22 with respect to the area of the frontal bone section 22.

The first magnet component 26 may also be located at, in addition to the frontal bone section 22, a right parietal bone section 54 of the first helmet 12. The right parietal bone section 54 may cover the entire right parietal bone 55 or less than the entire right parietal bone 55. The right parietal bone section 54 may also cover a portion of the right temporal bone 78 that is located adjacent to the right parietal bone 55. The first magnet component 26 is located in the right parietal bone section 54 such that it is located over a portion of the right parietal bone 55. As shown, the first magnet component 26 also is located over a portion of the right temporal bone 78. It is to be understood that the right parietal bone section 54 and the frontal bone section 22 refer to locations of the first helmet 12 and are not themselves discrete features or parts that are attached to or otherwise physically marked on the first helmet 12.

The first magnet component 26 may be located at an angle 98 from the central axis 14. In this regard, no magnet may be located between the central axis 14 in the zone swept by angle 98. This area of no magnets in the zone of angle 98 may be at the entire frontal bone section 22, at the entire right parietal bone section 54, at the entire left parietal bone section 56, or at the entire sections 22, 54 and 56. The angle 98 may be from 0 degrees-10 degrees, from 10 degrees-20 degrees, from 20 degrees-30 degrees, from 30 degrees-40 degrees, from 40 degrees-50 degrees, from 50 degrees-60 degrees, up to 70 degrees, no greater than 20 degrees, no greater than 30 degrees, no greater than 40 degrees, or no greater than 45 degrees in accordance with various exemplary embodiments. The location of the first magnetic component 26 may be defined as the first portion of the first magnetic component 26 that is closest to the central axis 14. As such, the angle 98 extends from the central axis 14 to the closest portion of the first magnetic component 26 to the central axis 14 in an angular direction, and does not extend to the center of the first magnetic component 26. In other embodiments, there may be one or more magnets within the area swept by angle 98 from the central axis 14 in these various sections 22, 54 and 56. The second magnet component 26 may be located at an angle 100 from the central axis 36 and can be arranged in this manner in the same ways as previously discussed with respect to the angle 98 and the first magnet component 26, and a repeat of this information is not necessary.

Figure 4:
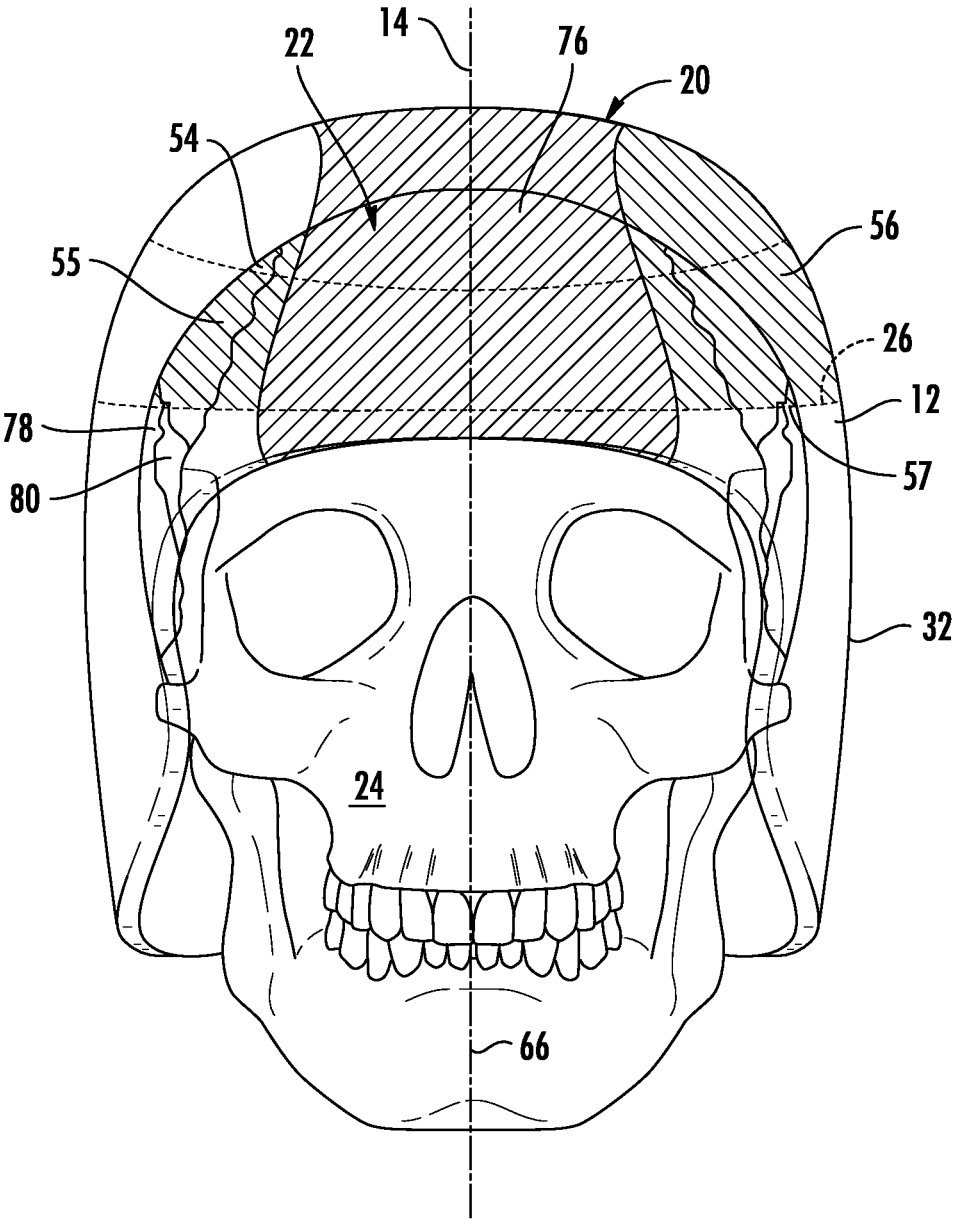
FIG. 4 is a front view of the skull and helmet of FIG. 3.

With reference now to FIG. 4, a front view of the helmet 12 on the skull of the wearer 24 is shown, and the first magnet component 26 is shown as extending across the entire frontal bone section 22 in the lateral direction. The first magnet component 26 is also located at the right parietal bone section 54 of the first helmet 12 as previously discussed. It is to be understood that the first magnet component 26 need not be located on all of the right parietal bone section 54 but may be located across less than the majority of the right parietal bone section 54, or may in other embodiments be located over a majority of the surface of the right parietal bone section 54. The helmet 12 may also have a left parietal bone section 56 that covers the left parietal bone 57 of the skull of the wearer 24. The first magnetic component 26 may also be located at the left parietal bone section 56 and may extend across all of the left parietal bone section 56, or may extend so as to cover less than all of the surface of the left parietal bone section 56.

Figure 5:
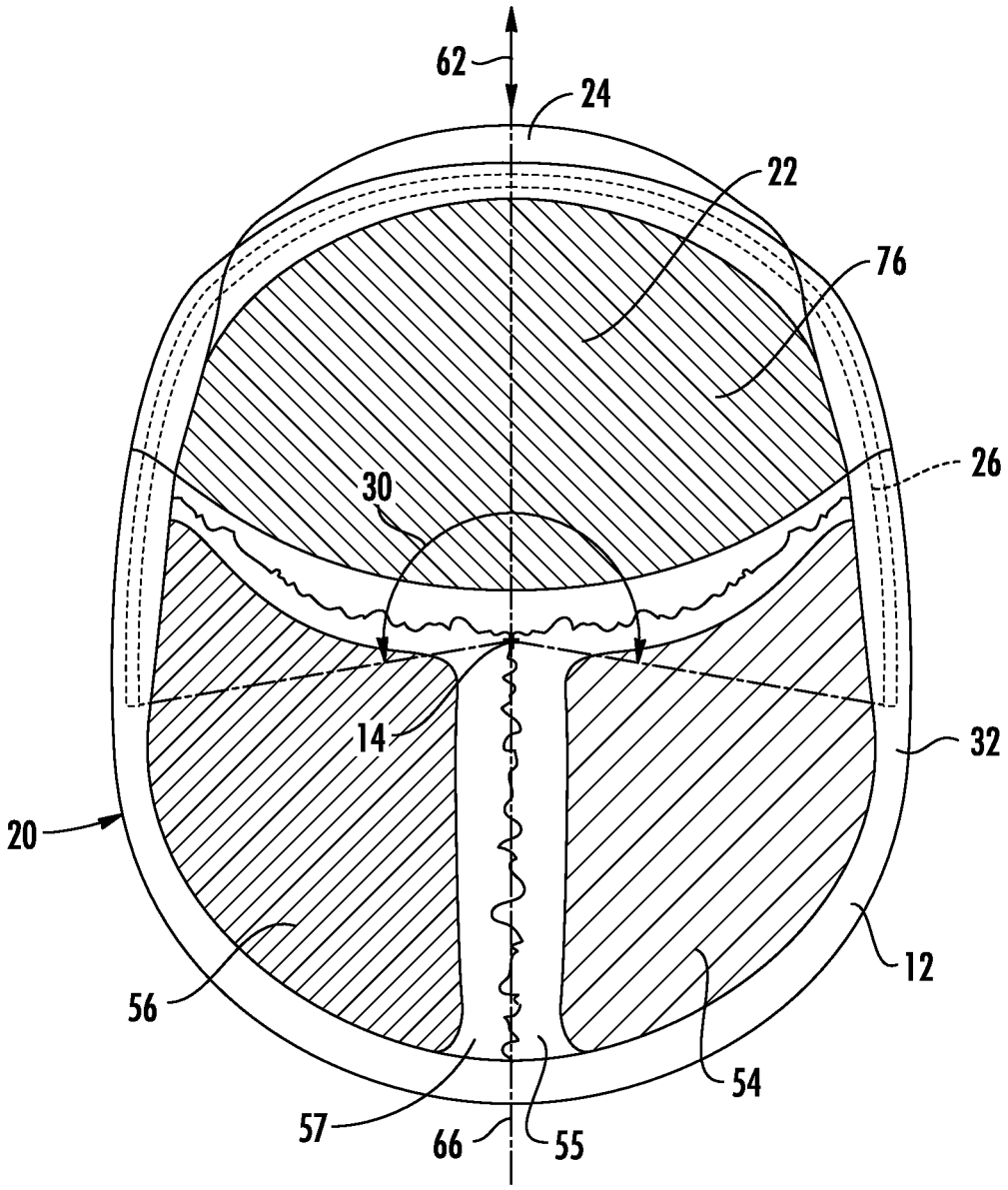
FIG. 5 is a top view of the skull and helmet of FIG. 3.

FIG. 5 is a top view of the first helmet 12 when worn by the wearer 24 on the skull, portions of which are illustrated. The first magnet section 26 extends across the entire lateral length of the frontal bone section 22, and into both the left parietal bone section 56 and the right parietal bone section 54. The extension 30 is approximately 190°. It is to be understood that the extension 30 of the first helmet 12, and the extension 52 of the second helmet 34 may be of any degree and that those illustrated are only exemplary. For example, the extensions 30, 52 may be from 5° to 10°, from 10° to 45°, from 45° to 90°, or up to 360° in accordance with various exemplary embodiments. Further, although described as extending across the entire frontal bone section 22, it is to be understood that the first magnet component 26 may extend across less than all of the lateral length of the frontal bone section 22 in other exemplary embodiments. Likewise, although described as extending into both of the left and right parietal sections 54, 56, it is to be understood that the first magnet component 26 need not extend into these sections 54, 56 in accordance with other embodiments of the headgear system 10.

Still further, although described as being located in the frontal bone section 22, it is to be understood that the first magnet component 26, and likewise the second magnet component 48, need not be present in the frontal bone section 22 of the helmets 12, 34. In this regard, the magnet components could be located outside of the frontal bone section 22 so as to be located only at the right parietal bone section 54, only at the left parietal bone section 56, or in both of the parietal bone sections 54, 56. As such, it is to be understood that the head gear system 10 is not limited to embodiments in which the magnets are located only at the frontal bone section 22. Although described with reference to the central axis 14 and the extension 30, it is to be understood that the second helmet 34 can be arranged in the various manners discussed concerning these components as compared to the second central axis 36 and the extension 52 of the second magnet component 48 around the central axis 36 as shown for example with reference back to FIG. 1. This extension 52 can be in any of the ranges previously discussed with respect to extension 30 in accordance with various exemplary embodiments. Also, it is to be understood that the second magnet component 48 may have an extension 52 that is the same as or different than the extension 30 of the first helmet 12 in the headgear system 10. In this regard, the locations, strengths, extensions and other properties of the first and second magnet components 26, 48 may be the same as or different from one another with respect to the various helmets of the headgear system 10.

Figure 6:
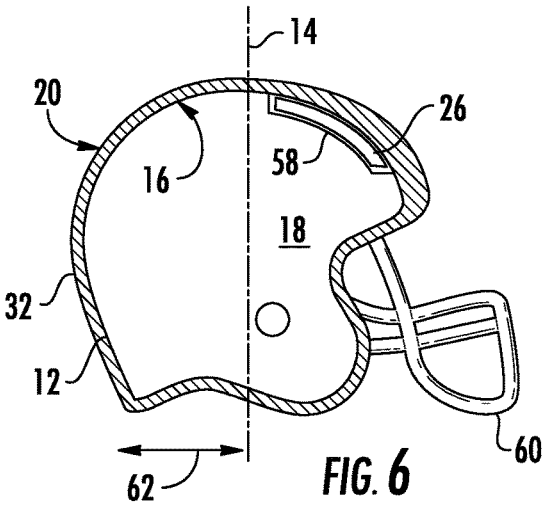
FIG. 6 is a cross-sectional side view of a helmet with a magnet component carried by a housing located on an inner surface of the helmet.

With reference now to FIG. 6, an exemplary embodiment of the first helmet 12 is shown in which the first magnet component 26 is located on an inner surface 16 of the first shell 32 of the first helmet 12. The first helmet 12 includes a first housing 58 into which the first magnet component 26 is located. The first housing 58 may completely encase the first magnet component 26 so that no portion of the first magnet component 26 directly faces the interior 18 but is instead completely surrounded by the first housing 58 such that the first housing 58 is disposed between the first magnet component 26 and the interior 18. The first housing 58 may be attached to the inner surface 16 of the first shell 32 through adhesives, mechanical fasteners, interlocking components, or the first housing 58 may be integrally formed with the first shell 32. The first housing 58 can be arranged so that the first magnet component 26 is removable therefrom. In other arrangements, the first housing 58 cannot be opened so that the first magnet component 26 is permanently retained therein. The first housing 58 may be sized so that the first magnet component 26 completely fills the interior of the first housing 58, or in some embodiments there may be a space present within the first housing 58 that includes the first magnet component 26. Also, although shown as being located on the inner surface 16, it is to be understood that the first housing 58 could be located on the exterior surface 20 in other arrangements of the first helmet 12. Likewise, the first housing 58 could extend through the first shell 32 so that a portion of the first housing 58 is located on the inner surface 16 and a portion is located on the exterior surface 20 with a yet additional portion located inside of the first shell 32. In this arrangement, the first magnet component 26 is likewise located on both surfaces 16, 20 and is located within the first shell 32. The first housing 58 may thus be a separate component from the first shell 32 and can have the same general shape as the first magnet component 26 in order to completely encase the first magnet component 26 in a similar profile.

Figure 7:
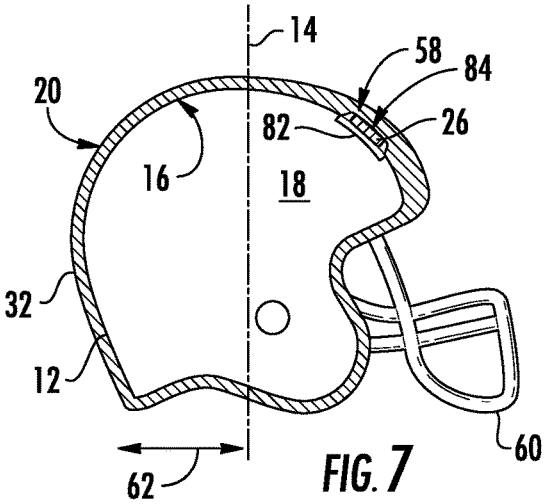
FIG. 7 is a cross-sectional side view of a helmet with a housing formed on an inner surface of the shell of the helmet.
Figure 8:
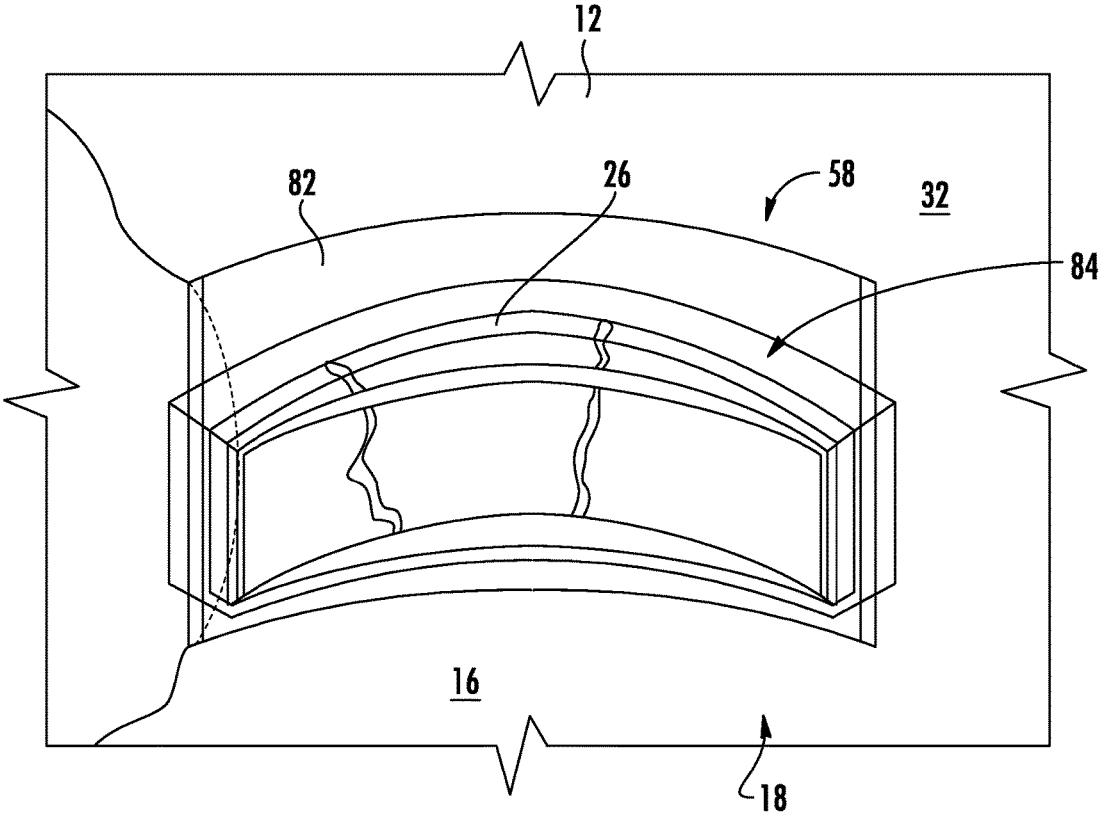
FIG. 8 is a perspective view in detail of the housing of FIG. 7.

FIGS. 7 and 8 disclose an alternative arrangement of the first helmet 12 in which the first housing 58 is formed through a combination of the first shell 32 and a housing plate 82. The first shell 32 defines a recess 84 in the inner surface 16. The recess 84 extends into the interior of the first shell 32 but in the embodiment shown does not extend to the exterior surface 20. The recess 84 has a profile that is larger than the first magnet component 26 but is shaped in a manner similar to that of the first magnet component 26. The first magnet component 26 may be inserted into the recess 84 and the first magnet component 26 may then be covered with a housing plate 82. The housing plate 82 may be larger than the first magnet component 26 so as to completely cover the side of the first magnet component 26 that faces the interior 18. The housing plate 82 may be attached to the inner surface 16 through adhesives, inner locking components, snaps, hook and loop type fasteners, or any other type of mechanical fastener. Although shown as being located on the inner surface 16 and thus extending outward from the inner surface 16, the housing plate 82 could be flush with the inner surface 16 in other arrangements such that the inner surface 16 is essentially continuous along the housing 58 without the discontinuity of the housing plate 82. Still further, in other embodiments the housing plate 82 may be located inside of the first shell 32 such that the housing plate 82 is in effect located farther from the interior 18 than the inner surface 16. In this sort of an arrangement, a depression on the inner surface 16 will be present where the housing plate 82 is located.

Impact between the helmets 12 and 34 may cause the associated magnets 26 and 48 to become damaged. In some instances, the first magnet component 26 may in fact break into multiple pieces if the first helmet 12 has a sufficiently high force imparted thereon. The housing 58 is enclosed in that it contains the first magnet component 26 therein and prevents the first magnet component 26 from falling out of the first housing 58 even when the first magnet component 26 is damaged and broken into multiple pieces. The multiple pieces of the first magnet component 26 will remain in essentially the same positions and the first magnet force 28 will work in the same originally designed manner. In effect, the enclosure of the first housing 58 allows the first magnet component 26 to function even when the first magnet component 26 is damaged and broken.

Figure 9:
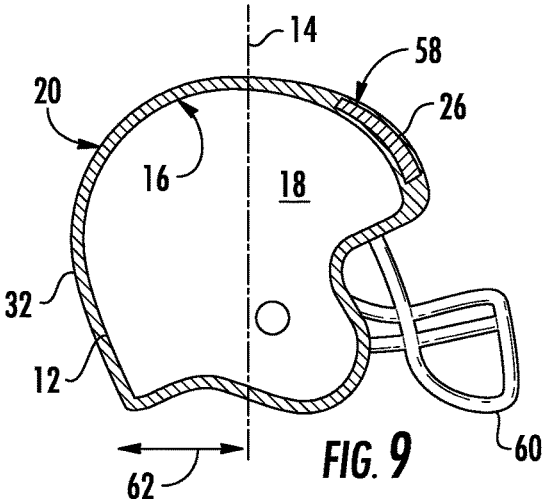
FIG. 9 is a cross-sectional side view of a helmet with a magnet component embedded within the shell of the helmet.

With reference now to FIG. 9, an alternative embodiment of the first helmet 12 is shown in which the housing 58 is located completely inside of the first shell 32. In this regard, no portion of the housing 58 is located on the exterior surface 20, and no portion is located on the inner surface 16. The housing 58 may be formed through a molding process of the first shell 32. The first magnet component 26 can be located within the first housing 58 and thus formed completely within the first shell 32 so that it is likewise not located on either of the surfaces 16 or 20. As the first magnet component 26 is completely contained within the first shell 32, impact forces onto the first shell 32 that may cause the first magnet component 26 to break into multiple pieces will still not prevent the first magnet component 26 from properly functioning as its location and orientation will remain the same even if broken or cracked.

Although described as being completely encased within the first housing 58, it is to be understood that the first magnet component 26 need not be completely encased in other arrangements. Here, the first housing 58 could function to hold the first magnet component 26 without completely surrounding the first magnet component 26 so that it is incorporated into the first helmet 12 but is not completely encased. The headgear system 10 may also include a second housing 70 of the second helmet 34 that functions to hold the second magnet component 48 to the second helmet 34. The second housing 70 can be constructed in the same manners as previously discussed with respect to the first housing 58 and a repeat of this information is not necessary.

Figure 10:
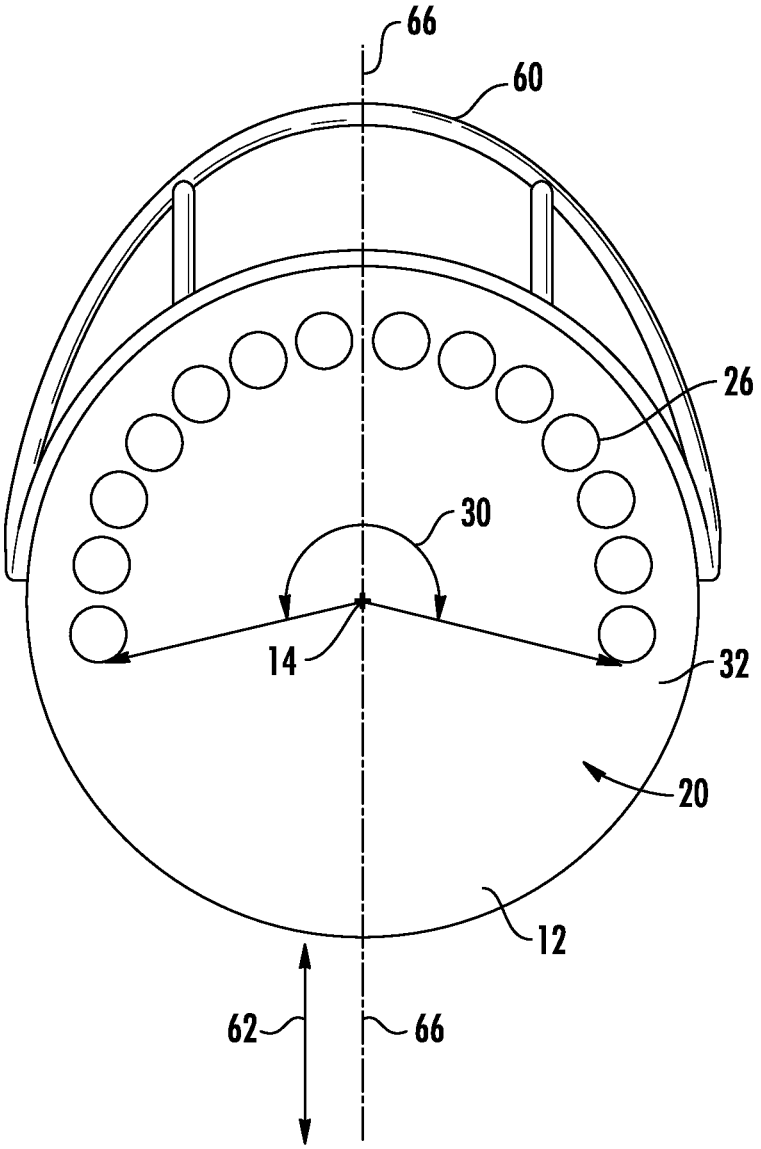
FIG. 10 is a top view of a helmet with a magnet component arranged as a plurality of individual magnets in accordance with another exemplary embodiment.

FIG. 10 shows an alternative exemplary embodiment of the headgear system 10 in which the first helmet 12 has a first magnet component 26 that is composed of a plurality of magnets instead of a single magnet. In this regard, the first magnet component 26 is made up of 14 separate magnets that are located on the exterior surface 20. In other embodiments the first magnet component 26 may be made from 2 to 10, from 10 to 20, from 20 to 40, or up to 100 separate magnets. The plurality of magnets that make up the first magnet component 26 are arranged in a horseshoe or halo shape and have an extension 30 that is approximately 190° about the central axis 14. The variously placed magnets are symmetrical but need not be symmetrical in accordance with other exemplary embodiments. Further, although shown as being located in the frontal section of the first helmet 12 and extending in a halo or horseshoe shape, it is to be understood that the various magnets located on the first helmet 12 that make up the first magnet component 26 can be located at any portion of the first helmet 12 and need not be located at the front of the first helmet 12 and need not have a horseshoe or halo shaped configuration in accordance with other exemplary embodiments. As such, the first magnet component 26 and the second magnet component 48 can be located at any portion of the respective shells 32, 68 and may be but a single magnet or can be multiple magnet as desired.

Figure 11:
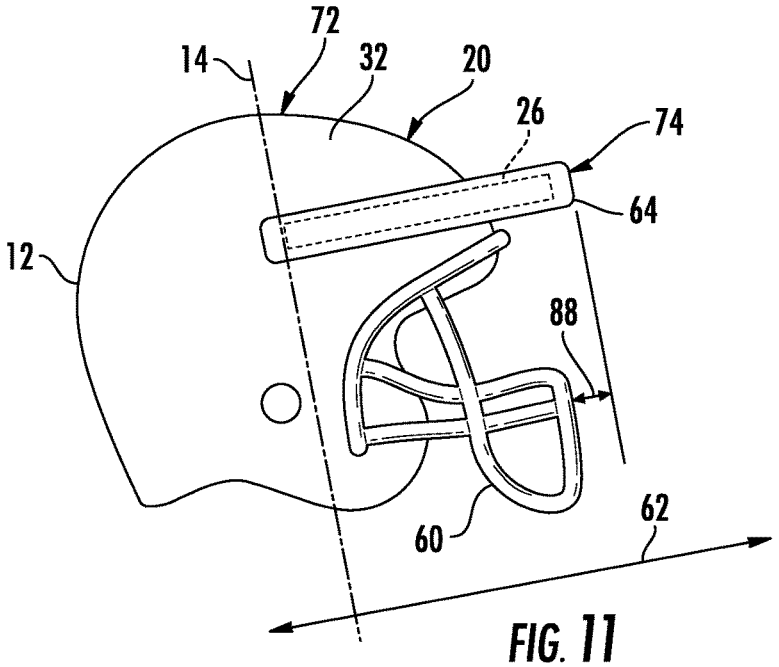
FIG. 11 is a side view of a helmet that has a projection that carries a magnet component.
Figure 12:
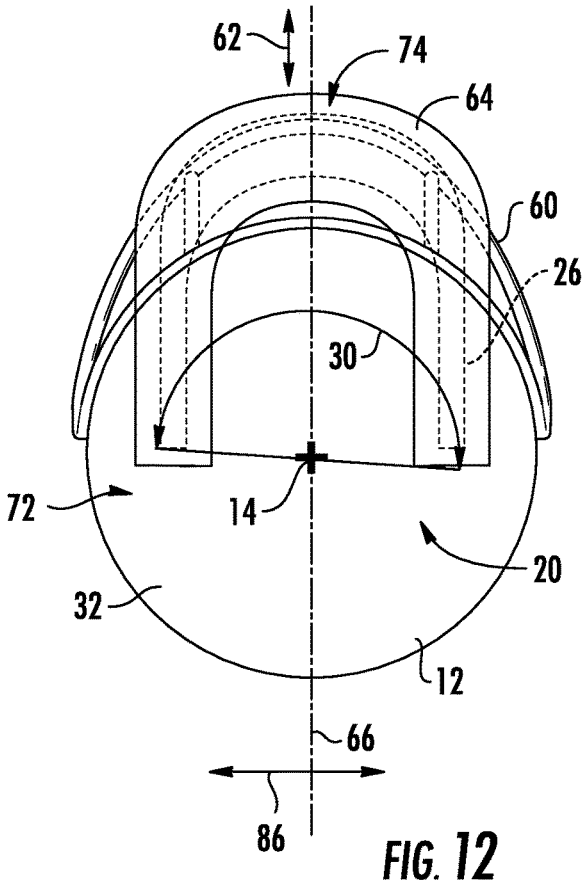
FIG. 12 is top view of the helmet of FIG. 11.
Figure 13:
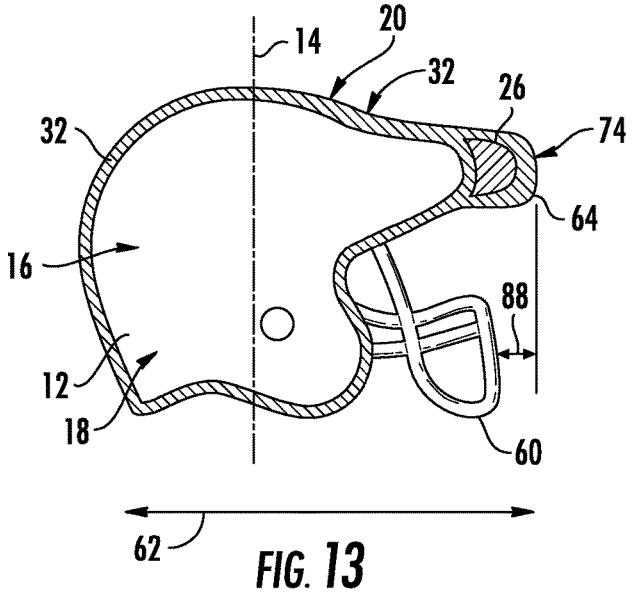
FIG. 13 is a cross-sectional side view of the helmet of FIG. 11.

FIGS. 11-13 illustrate an alternative exemplary embodiment of the headgear system 10 in which the first helmet 12 includes a projection 64 that carries the first magnet component 26. The protrusion 64 extends from an exterior surface 72 of the first shell 32. The protrusion 64 has its own exterior surface 74 that along with the exterior surface 72 of the first shell 32 makes up the exterior surface of the first helmet 12. The protrusion 64 extends generally in the longitudinal direction 62, but could be angled in other embodiments so that the protrusion 64 has a component that extends both in the longitudinal direction 62 and in the vertical direction that is parallel to the central axis 14. The protrusion 64 can be a separate piece from the first shell 32, or may be formed integrally with the first shell 32 so that they form essentially a single component.

The protrusion 64 may extend farther in the longitudinal direction 62 than any portion of the exterior surface 72 of the first shell 32. With reference to FIG. 12, the protrusion 64 is arranged so that it does not extend beyond the exterior surface 72 in the lateral direction 86 of the first helmet 12. However, in other arrangements the protrusion 64 may be sized or configured so that it in fact does extend beyond the exterior surface 72 on the left side of the first shell 32 in the lateral direction 86, and so that the protrusion 64 extends beyond the exterior surface 72 on the right side of the first shell 32 in the lateral direction 86. Still further, in other embodiments the protrusion 64 may in fact extend rearward of the exterior surface 72 so that no portion of the exterior surface 72 extends rearward beyond the protrusion 64 in the longitudinal direction 62. The protrusion 64 may be a portion of the first helmet 12 that extends farther outward from the interior 18 than immediately adjacent portions of the protrusion 64. In this regard, the exterior surface 74 may be farther from the interior 18 than the portions of the exterior surface 72 immediately adjacent to the exterior surface 74. Although shown as being horseshoe shape, it is to be understood that the protrusion 64 can be variously shaped in other exemplary embodiments. For instance, the protrusion 64 can be oval or racetrack in shape such that the protrusion 64 extends as a halo completely around the first shell 32. Further, multiple protrusions 64 can be present on the first helmet 12 and these protrusions 64 may be located at any location on the exterior surface 20.

The first magnet component 26 is located in the protrusion 64. With reference to FIG. 13, the first magnet component 26 is encased within the protrusion 64 such that the first magnet component is not located on the inner surface 16 or on the exterior surface 20. In other embodiments the first magnet component 26 can be located on the inner surface 16 at the protrusion 64, but not inside of the shell 32 or on the exterior surface 74. The first magnet component 26 may take a shape that essentially follows the shape of the protrusion 64. With reference back to FIG. 12, the first magnet component 26 is horseshoe in shape and follows the horseshoe-shaped protrusion 64 so as to have an extension 30 that is 180°. Likewise, the protrusion 64 extends 180° about the central axis 14. However, in other exemplary embodiments the protrusion 64 may have a different amount of extension about the central axis 14 than the extension 30. The first magnet component 26 may be located at only certain portions of the protrusion 64 and need not follow the entire profile of the protrusion 64. The first magnet component 26 can be made of a single magnet or may be made of multiple magnets as discussed herein, and the first magnet component 26 may be located at both the protrusion 64 and at other areas of the first helmet 12 such as on the exterior or inner surfaces 20, 16 of the first shell 32.

The protrusion 64 functions to extend the distance of the first magnet component 26 away from the central axis 14 so that it provides for a greater degree of repellent force. The protrusion 64 may be arranged on the first helmet 12 so that it is farther out in the longitudinal direction 62 than other portions of the first helmet 12 to increase the degree of repellent and to ensure that the repellent forces of the headgear system 10 are encountered before contact of the various helmets 12, 34 during play. With reference to FIGS. 11 and 13, it may be seen that the projection 64 extends in the longitudinal direction 62 so as to be located a distance 88 in the longitudinal direction 62 that is farther than the face mask 60. The terminal distal end of the projection 64 is thus a distance 88 in the longitudinal direction 62 from the terminal most distal point of the face mask 60. In other arrangements the terminal distal end of the protrusion 64 may be located at the same distance as the terminal distal end of the face guard 60 such that the distance 88 is zero. In yet other arrangements, the protrusion 64 does not extend as much in the longitudinal direction 62 as does the face guard 60 such that the face guard 60 is farther from the central axis 14 than the protrusion 64 in the longitudinal direction 62.

Experiments Carried Out in Accordance with Certain Exemplary Embodiments

Various experiments were carried out in accordance with different exemplary embodiments of the headgear system 10. The experiments sought to obtain data regarding functionality of the headgear system 10. The testing apparatus included a skid/sled apparatus design in which a headform was carried and onto which a helmet 12 was placed. The headform included a flexible neck design that was included in order to demonstrate neck movement.

Accelerometers were placed into the helmets 12, 34 at the top of the helmet 12 which is at the highest point of the helmet 12, 34 in the vertical direction and may in fact be at the central axes 14, 36. Left ear accelerometers were placed onto the helmets 12, 34 at the left ears of the helmets 12, 34 that cover the left temporal bones. Right ear accelerometers were placed onto the helmets 12, 34 at the right ears of the helmets 12, 34 that cover the right temporal bones 78. Accelerometers and gyroscopes were placed inside of the headforms onto which the helmets 12, 34 were placed. The headform is a model or other component that simulates the head of the wearer in the impact. The headform may be sized and shaped in a manner similar to the head of the wearer. These accelerometers and gyroscopes may measure the forces experienced by the heads of the wearers 24, 46 of the helmets 12, 34 instead of the forces experienced by the helmets 12, 34 themselves. Data from these accelerometers and gyroscopes may better help to determine the actual impact forces experienced by the wearers 24, 46 instead of those simply imparted onto the helmets 12, 34. The instruments placed onto the helmets 12, 34 may be used to measure accelerations, movements, and total Gs at impact. The gyroscope information may be used to determine angular rotations and deflections within the headforms. Motion cameras were set up around the helmets 12, 34 to record movement, rotations, and deflections of the helmets 12, 34, headforms, and necks.

Figure 14:
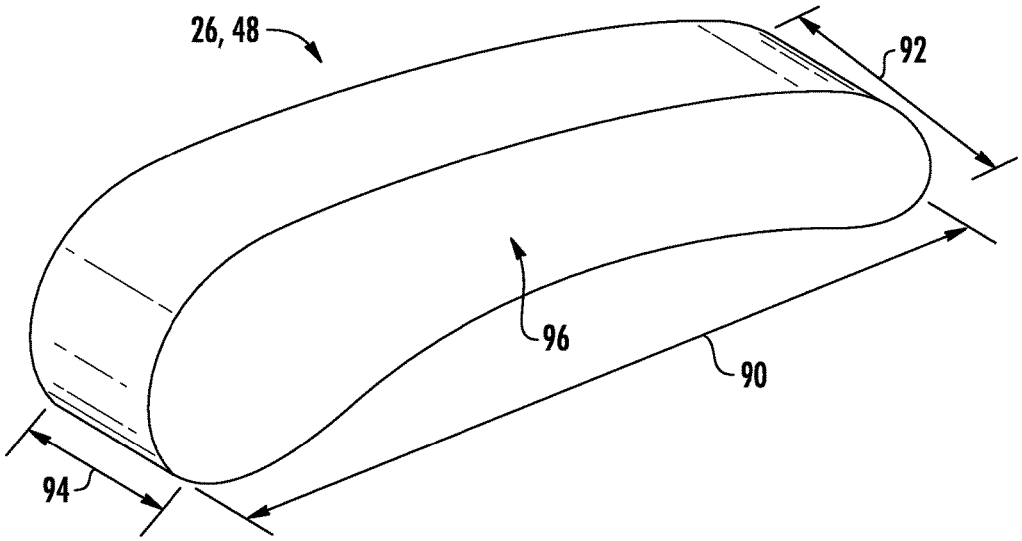
FIG. 14 is a perspective view of a magnet component in accordance with one exemplary embodiment.

The helmets 12, 34 when including the first and second magnet components 26, 48 had the magnet components 26, 48 placed at the center point of the frontal bone sections 22, 44 and protrusions 64 were not present in the helmets 12, 34. The frontal bone sections 22, 44 had a sloped profile in the area where the first and second magnet components 26, 48 were located. With reference to FIG. 14, the first and second magnet components 26, 48 used in various experiments is illustrated with a height 90, a width 92, and a thickness 94. In certain experiments, the height 90 was 2 inches, the width 92 was 1 inch, and the thickness 94 was 0.5 inches. The first and second magnet components 26, 48 were made of rare earth neodymium N-50-52 grade material. Some trials included the first and second magnet components 26, 48 on the inner surface 16, and in later trails the first and second magnet components 26, 48 were on the exterior surface 20. The helmets 12 and 34 that impact one another do so in a crown-to-crown type hit in which the frontal bone section 22 of helmet 12 impacts the frontal bone section 44 of helmet 34. The impact is arranged so that the magnet components 26, 48 are either aimed at one another pre-impact, or the point of impact is close to the magnet components 26, 48 pre-impact. The helmets were new 2014 Schutt DNA Men's XL model which did not include a protrusion 64.

The following experiments were conducted to compare helmets 12, 34 that include magnetic components 26, 48 to those helmets 12, 34 that do not include any magnetic components 26, 48. Various test runs at impact speeds ranging from 13-16 mph were conducted in which both helmet 12 and helmet 34 were each run at the same speed at one another (for example helmet 12 was moving at 13 mph and helmet 34 was moving at 13 mph in the opposite direction until they impact). Readings in which the magnetic components 26, 48 were on the inner surface 16 and were on the exterior surface 20 are both disclosed. The results are illustrated below in table 1.

TABLE 1

Internal & External Resultant Impact Accelerations [Gs]

| Session | Trial | Magnet | Impact Speed [mph] | Internal Resultant Impact Accelerations [Gs] | Impact Frame | External Resultant Impact Acceleration [Gs] |
|---|---|---|---|---|---|---|
| 14 | 2 | None | 13.02 | 64.5630 | 5648 | 62.6491 |
| 14 | 3 | None | 12.48 | 55.1215 | 5316 | 65.4115 |
| 14 | 4 | None | 12.71 | 58.0546 | 5859 | 70.9851 |
| 14 | 6 | None | 14.64 | 79.4619 | 5382 | 91.6580 |
| 14 | 7 | None | 15.38 | 95.4800 | 6333 | 118.2192 |
| 14 | 10 | None | 14.14 | 83.7737 | 5904 | 94.7417 |
| 14 | 12 | None | 14.2 | 85.9893 | 5773 | 86.8505 |
| 14 | 13 | None | 12.84 | 61.5003 | 6165 | 68.9999 |
| 14 | 14 | None | 15.03 | 92.5841 | 5895 | 83.2121 |
| 14 | 15 | None | 15.05 | 86.3470 | 5555 | 84.5973 |
| 14 | 16 | None | 12.95 | 65.0469 | 7666 | 79.0912 |
| 14 | 17 | None | 15.56 | 98.8622 | 6480 | 97.8376 |
| 14 | 18 | None | 15.27 | 88.2082 | 7901 | 76.9964 |
| 14 | 19 | None | 15.37 | 103.1886 | 7503 | 88.2685 |
| 8 | 2 | None | 12.76 | 62.7032 | 8147 | 82.6065 |
| 8 | 4 | None | 13.93 | 70.0829 | 6075 | 81.2770 |
| 8 | 13 | None | 15.14 | 93.6158 | 6169 | 109.6729 |
| 8 | 14 | None | 15.27 | 114.6849 | 8325 | 101.7872 |
| 30 | 1 | Outside | 14.5 | 56.7861 | 6249 | 126.082 |

TABLE 1-continued

| Internal & External Resultant Impact Accelerations [Gs] | | | | | | |
|---|---|---|---|---|---|---|
| Session | Trial | Magnet | Impact Speed [mph] | Internal Resultant Impact Accelerations [Gs] | Impact Frame | External Resultant Impact Acceleration [Gs] |
| 30 | 4 | Outside | 15.3 | 52.728 | 5035 | 158.8953 |
| 30 | 6 | Outside | 15.2 | 57.3575 | 5168 | 111.5237 |
| 30 | 7 | Outside | 15.8 | 57.4683 | 4524 | 111.5822 |
| 31 | 1 | Outside | 13.2 | 43.6134 | 3887 | 101.7321 |
| 31 | 2 | Outside | 14.92 | 63.9489 | 4139 | 152.2252 |
| 31 | 3 | Outside | 14.61 | 63.4951 | 5101 | 116.3415 |
| 31 | 5 | Outside | 15.82 | 77.2044 | 3434 | 129.4882 |
| 32 | 1 | Outside | 14.12 | 51.2728 | 3618 | 127.7638 |
| 32 | 2 | Outside | 14 | 51.8988 | 3048 | 98.5457 |
| 32 | 3 | Outside | 14.35 | 51.0601 | 3897 | 132.5067 |
| 32 | 6 | Outside | 14.84 | 50.7287 | 3097 | 89.5054 |
| 32 | 7 | Outside | 15.32 | 56.6589 | 2730 | 125.0977 |
| 32 | 8 | Outside | 15.32 | 55.679 | 2740 | 131.1796 |
| 29 | 1 | Outside | 13.2 | 47.0833 | 5136 | 121.0203 |
| 29 | 4 | Outside | 13.6 | 57.6699 | 8327 | 107.0759 |
| 29 | 5 | Outside | 13.7 | 56.9571 | 5390 | 91.6911 |
| 33 | 2 | Outside | 15.67 | 51.1999 | 3082 | 132.4942 |
| 33 | 3 | Outside | 15.84 | 56.2091 | 2527 | 107.0416 |
| 33 | 4 | Outside | 16.06 | 56.2162 | 2530 | 141.8467 |
| 33 | 5 | Outside | 15.64 | 60.9593 | 2496 | 94.3129 |

Figure 15:
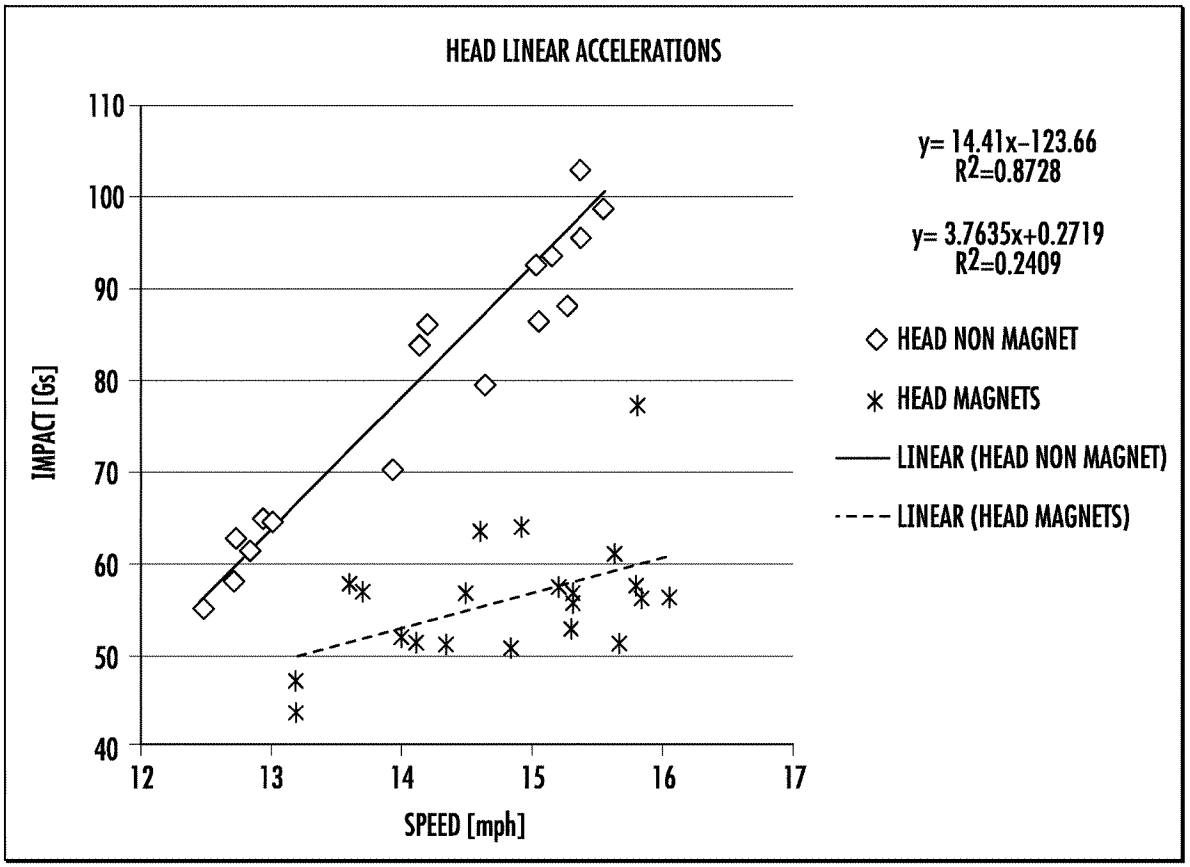
FIG. 15 is a table that shows speed versus impact for linear accelerations of a head form.

FIG. 15 illustrates the linear acceleration of the headform at various speeds for both the magnetic component 26, 48 runs and the non-magnetic component 26, 48 runs. FIG. 15 shows the maximum impact of helmet 12 (linear acceleration) in Gs vs. Speed of the helmets 12, 34.

Figure 16:
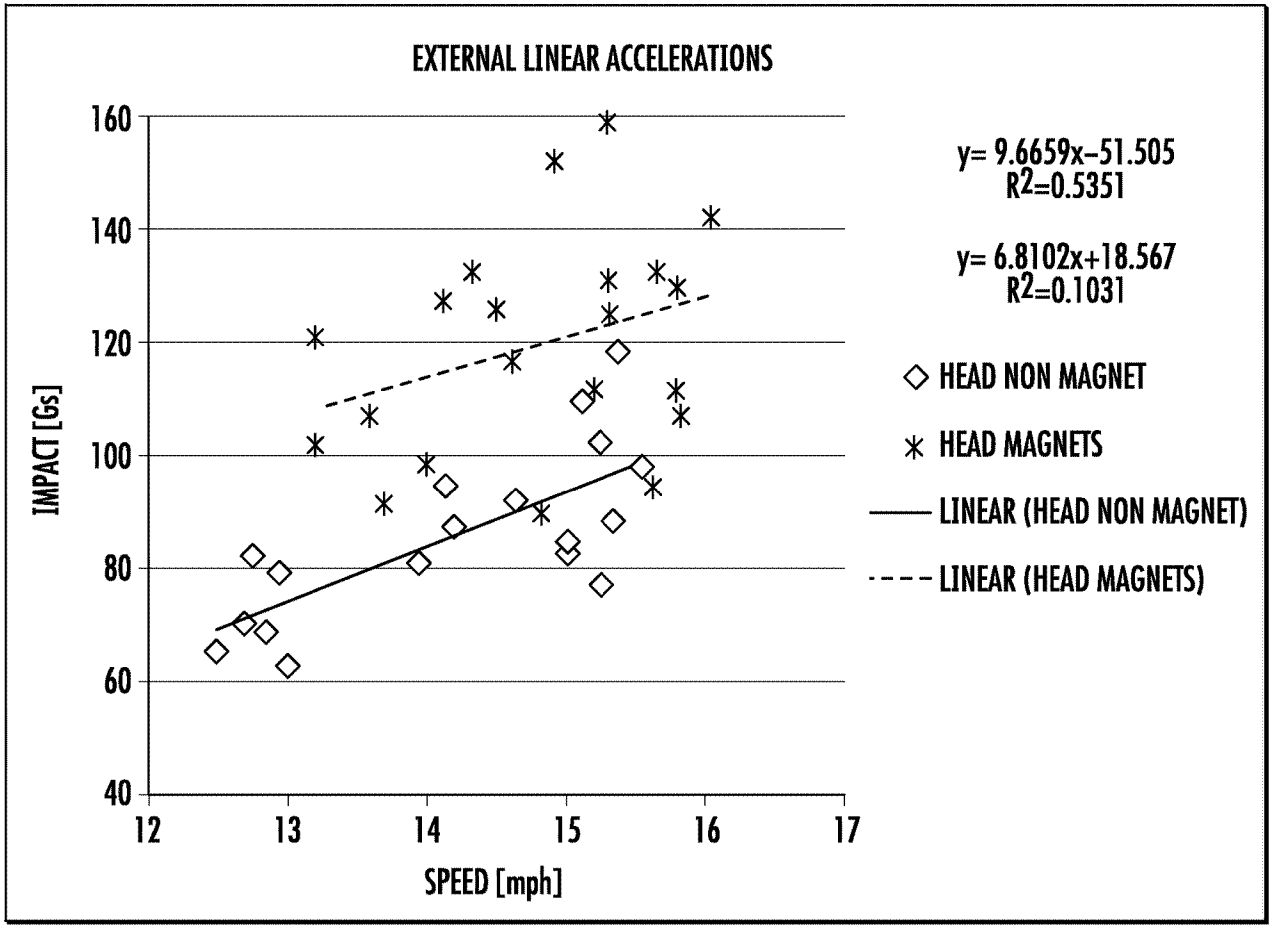
FIG. 16 is a table of speed versus impact for linear accelerations as measured on the helmet.

FIG. 16 illustrates the external linear acceleration which is the acceleration measured on the helmets 12, 34 at the top accelerometer which as previously described is located at the very top of the helmets 12, 34 at or very close to the central axes 14, 36. FIG. 16, like FIG. 15, is constructed of the data from Table 1 and includes impacts for both magnet and non-magnet components 26, 48 in helmets 12, 34. FIG. 16 shows the maximum impact of helmet 12 (linear acceleration) in Gs vs. speed of both helmets 12 and 34.

The takeaway from the various trials, and as illustrated with reference to FIGS. 15 and 16 is that the trendlines almost flip when comparing G force impact on the external sensors (on the helmet) and those that are internal (in the headform). Applicants theorize that force resultant vectors increase on the outside of the helmets 12, 34 as a result of the tangential direction change caused by the magnetic components 26, 48. The internal readings on the headform decrease. With no magnetic components 26, 48 the impact forces are less than those when magnetic components 26, 48 are present and their trendlines are a linear relationship. Although greater impact is present on the helmets 12, 34, it is the case that the internal forces of the headform, those being the forces that will actually be imparted/felt by the head of the wearer 24 and thus those that will cause concussion, are the opposite. Not only are the impact forces less, it was surprisingly found that as speed increases the slope of the impact/speed line is significantly less than that of the non-magnetic component 26, 48 trials. In fact no trial was run with the magnetic components 26, 48 that caused an impact of 80 G on the headform. Research shows that concussions occur when the head is subjected to at least 80 G of acceleration, thus demonstrating that the present headgear system 10 prevents concussions up to 16 mph collisions. Without the magnetic components 26, 48, 80 Gs onto the headform was experienced at approximately 14 or 15 mph.

The sensors used in the various experiments may be small, low power, 3-axis+/−200 g Accelerometers having the trade name ADXL377 and provided by Analog Devices having office at One Technology Way, PO BOX 9106 Norwood, Mass. 02062, USA. The gyroscopes used in the various experiments may be piezoelectric vibrating gyroscopes sold under the trademark GYROSTAR® provided by Murata Manufacturing Co., Ltd. having offices located at 1-10-1, Higashi Kotari, Nagaokakyo-shi, Kyoto 617-8555, Japan. The headform that is used, including the head, neck, or other simulated body parts, may be one such as the HYBRID III fiftieth percentile crash test dummy provided by the National Highway Traffic Safety Administration having offices located at 1200 New Jersey Avenue, SE, West Building, Washington, D.C. 20590, USA.

Additional experiments were run in which motion capture data was used to determine movement, rotations, and deflections of the helmet 12. Position changes before and after impact may be calculated in two ways. First, the total change in position pre-impact, that is seven frames before impact, may be determined and assigned as delta1. The total change in position post-impact from the impact frame to the maximum deviation after impact can be determined and assigned as delta2. The second way is to use arrays containing the incremental change in position between each frame before (delts1) and after (delts2) impact.

Figure 17:
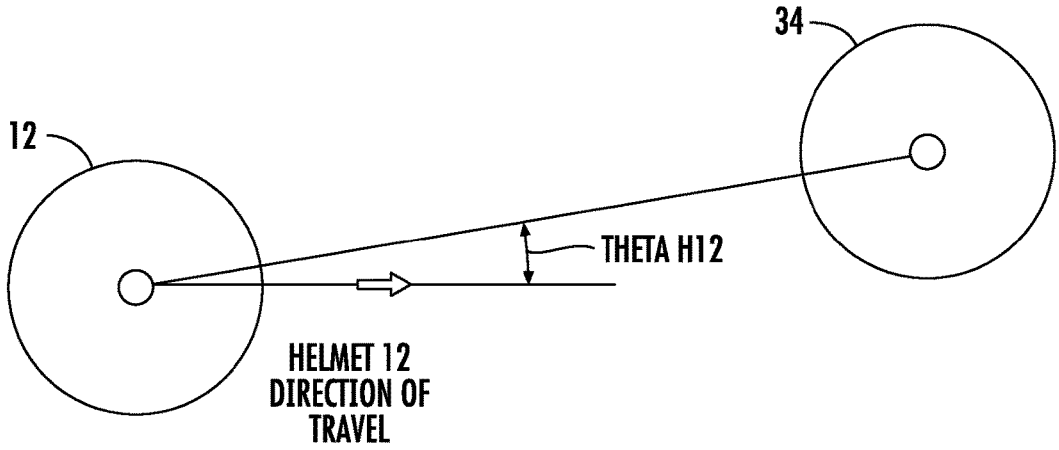
FIG. 17 is a top view showing positional deflection between two repelling helmets.

Next, helmet deflections can be calculated in two ways. The first way uses a vector (H12) connecting the top location of helmet 12 to the top area of helmet 34. The H12 vector is projected onto an XY plane that is parallel to the floor to show how the helmets are laterally deflected with respect to each other as an angle from their line of travel (ThetaH12). This is illustrated with reference to FIG. 17. Similarly to determining the position changes before and after impact, the total change in angle before (ThetaH12delta1) and after (ThetaH12delta2), and incremental change arrays before (ThetaH12delts1) and after (ThetaH12delts2) were calculated.

Figure 18A:
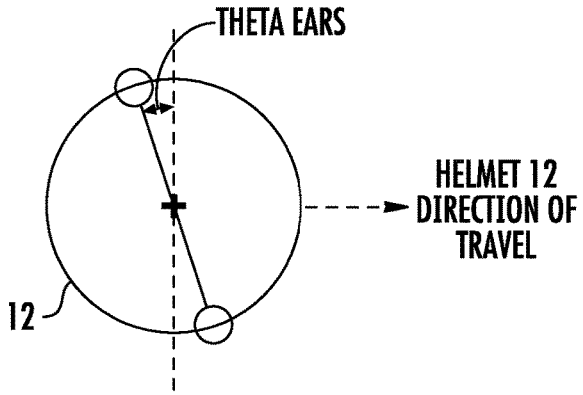
FIG. 18A is a top view of a helmet showing the twist of the helmet.

The second method of calculating helmet 12 deflection uses the left and right ear markers on helmet 12 to determine how the helmet 12 rotates during the experiment. This measurement may be seen with reference to FIG. 18A. A vector is created between the two ear markers (ears) and projected onto the XY plane to determine the helmet 12 rotation relative to the global coordinate system. The total change in position for the ears before (ThetaEarsdelts1) and after (ThetaEarsdelts2) can be calculated.

Figure 18B:
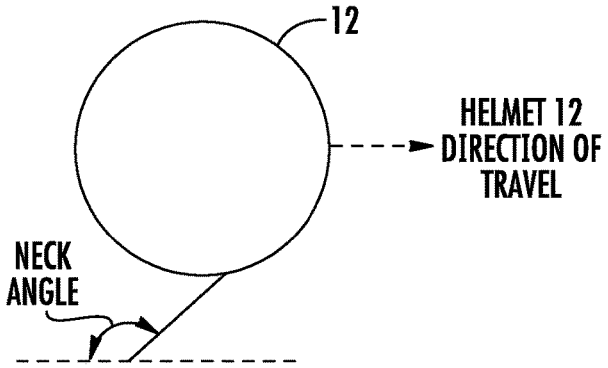
FIG. 18B is a side view of a helmet carried by a sled that shows a neck angle of the neck in relation to the horizontal.

Still further, neck deflections can be calculated before and after contact. The sled angle can be determined using the shoulder midpoint (MSHO) and back marker, and the neck angle can be calculated from the helmet 12 top marker and right mid neck marker (Right_Neck_Mid). The dynamic neck angle is calculated as the angle resulting before and after impact. The neck angle may be seen with reference to FIG. 18B. The total and incremental changes for deflection angle were calculated in the same manner as was for position and helmet deflection. The maximums for each angular parameter for ThetaH12, for the ear twist, and for the neck angle for both before and after impact can be calculated.

The following Table 2 shows various runs with non-magnetic components 26, 48 in the helmets 12, 34, and those with magnetic components 26, 48 in the helmets 12, 34. The magnetic components 26 and 48 were each a single curved, strong magnet.

TABLE 2

| Trial | Impact Speed [mph] | Magnets |
|---|---|---|
| S14T2 | 13.02 | No |
| S14T3 | 12.48 | No |
| S14T4 | 12.71 | No |
| S14T6 | 14.64 | No |
| S14T7 | 15.38 | No |
| S14T10 | 14.14 | No |
| S14T12 | 14.2 | No |
| S14T13 | 12.84 | No |
| S14T14 | 15.03 | No |
| S14T15 | 15.05 | No |
| S14T16 | 12.95 | No |
| S14T17 | 15.56 | No |
| S14T18 | 15.27 | No |
| S14T19 | 15.37 | No |
| S8T02 | 12.76 | No |
| S8T03 | 11.17 | No |
| S8T04 | 13.93 | No |
| S8T13 | 15.14 | No |
| S8T14 | 15.27 | No |
| S2.5T02 | 13.35 | Yes |
| S2.5T04 | 12.27 | Yes |
| S2.5T05 | 10.09 | Yes |
| S2.5T06 | 13.31 | Yes |
| S2.5T07 | 12.17 | Yes |
| S2.5T08 | 12.66 | Yes |
| S2.5T09 | 11.67 | Yes |
| S2.5T10 | 13.38 | Yes |
| S2.5T11 | 15.49 | Yes |
| S2.5T12 | 15.27 | Yes |
| S2.5T13 | 14.27 | Yes |
| S2.5T15 | 15.59 | Yes |
| S2.5T16 | 15.41 | Yes |
| S2.5T17 | 15.18 | Yes |
| S4.5T03 | 13.07 | Yes |
| S4.5T04 | 14.37 | Yes |
| S4.5T05 | 14.31 | Yes |
| S4.5T13 | 14.58 | Yes |
| S4.5T14 | 14.45 | Yes |
| S4.5T16 | 13.64 | Yes |
| S4.5T17 | 13.95 | Yes |
| S4.5T18 | 14.51 | Yes |
| S4.5T19 | 14.24 | Yes |
| S4.5T21 | 12.87 | Yes |
| S4.5T22 | 13.76 | Yes |
| S4.5T26 | 13.34 | Yes |

TABLE 2-continued

| Trial | Impact Speed [mph] | Magnets |
|---|---|---|
| S4.5T27 | 12.55 | Yes |
| S4.5T28 | 14.02 | Yes |
| S4.5T29 | 14.54 | Yes |

The following Table 3 shows runs with no magnetic components 26, 48 in the helmets 12, 34 and the resulting head accelerations, deflections, and rotations of helmet 12. The sensors that are read are from the headform.

TABLE 3

Min and Max Deflections and Rotations of Helmet 1 - No Magnets

| | Helmet 1 [deg/sec] | | | | | | Maximum Resultant Angular |
|---|---|---|---|---|---|---|---|
| Trial | Min x | Max X | Min Y | Max Y | Min Z | Max Z | Accelera-tion |
| S14T2 | −0.899 | 0.621 | −0.483 | 0.553 | −7.727 | 3.003 | 7.730 |
| S14T3 | −0.787 | 0.559 | −0.647 | 0.799 | −6.880 | 0.865 | 6.886 |
| S14T4 | −0.781 | 0.420 | −0.604 | 0.646 | −7.288 | 1.531 | 7.316 |
| S14T6 | −0.824 | 1.292 | −0.353 | 0.861 | −8.591 | 1.985 | 8.612 |
| S14T7 | −0.723 | 0.511 | −0.643 | 1.972 | −9.118 | 2.085 | 9.139 |
| S14T10 | −0.498 | 0.380 | −0.387 | 0.947 | −8.349 | 2.256 | 8.381 |
| S14T12 | −0.652 | 0.752 | −0.428 | 0.747 | −8.891 | 2.797 | 8.908 |
| S14T13 | −0.606 | 0.558 | −0.412 | 1.157 | −7.254 | 2.898 | 7.281 |
| S14T14 | −0.574 | 0.408 | −0.491 | 1.524 | −8.899 | 2.684 | 8.914 |
| S14T15 | −0.609 | 0.839 | −0.521 | 0.826 | −8.938 | 2.281 | 8.953 |
| S14T16 | −0.820 | 0.883 | −0.401 | 0.976 | −7.707 | 2.136 | 7.725 |
| S14T17 | −0.752 | 0.420 | −0.350 | 2.061 | −9.524 | 4.440 | 9.546 |
| S14T18 | −0.546 | 0.908 | −0.244 | 0.723 | −9.035 | 3.933 | 9.054 |
| S14T19 | −0.498 | 0.407 | −0.529 | 1.206 | −9.486 | 3.746 | 9.507 |
| S8T02 | −0.378 | 0.480 | −0.779 | 0.598 | −7.742 | 2.549 | 7.750 |
| S8T03 | −0.391 | 0.536 | −0.027 | 0.937 | −6.847 | 2.250 | 6.860 |
| S8T04 | −0.310 | 0.691 | −0.198 | 1.022 | −8.155 | 2.162 | 8.166 |
| S8T13 | −0.395 | 0.781 | −0.201 | 0.550 | −9.331 | 1.046 | 9.339 |
| S8T14 | −0.537 | 0.576 | −0.169 | 1.172 | −9.376 | 0.574 | 9.389 |

The following Table 4 shows trials the same as that previously described with respect to Table 3, but the helmets 12, 34 are in this table equipped with magnetic components 26, 48.

TABLE 4

Min and Max Deflections and Rotations of Helmet 1 - Magnets

| | Helmet 1 [deQ/sec] | | | | | | Maximum Resultant Angular |
|---|---|---|---|---|---|---|---|
| Trial | Min X | Max X | Min Y | Max Y | Min Z | Max Z | Accelera-tion |
| S2.5T02 | −0.969 | 1.248 | −0.794 | 0.958 | −8.380 | 0.270 | 8.435 |
| S2.5T04 | −1.088 | 0.854 | −1.573 | 0.186 | −7.131 | 0.242 | 7.221 |
| S2.5T05 | −0.790 | 0.644 | −1.413 | 0.171 | −5.197 | 0.309 | 5.351 |
| S2.5T06 | −0.944 | 1.123 | −1.619 | 0.194 | −7.684 | 0.190 | 7.781 |
| S2.5T07 | −1.169 | 0.975 | −1.478 | 0.773 | −7.284 | 0.329 | 7.404 |
| S2.5T08 | −1.243 | 1.096 | −1.483 | 0.195 | −7.817 | 0.247 | 7.956 |
| S2.5T09 | −0.213 | 0.645 | −0.806 | 0.985 | −5.026 | 0.853 | 5.071 |
| S2.5T10 | −0.676 | 0.972 | −0.231 | 1.170 | −8.021 | 0.168 | 8.068 |
| S2.5T11 | −0.182 | 0.707 | −0.404 | 1.122 | −9.199 | 0.181 | 9.216 |
| S2.5T12 | −0.358 | 0.650 | −0.220 | 0.546 | −9.214 | 0.167 | 9.215 |
| S2.5T13 | −0.713 | 0.604 | −0.558 | 0.755 | −8.266 | 0.386 | 8.295 |
| S2.5T15 | −0.974 | 0.166 | −1.580 | 0.970 | −9.257 | 0.154 | 9.365 |
| S2.5T16 | −0.861 | 0.354 | −1.300 | 0.814 | −9.213 | 0.197 | 9.297 |
| S2.5T17 | −0.876 | 0.361 | −1.601 | 0.990 | −9.331 | 0.213 | 9.469 |
| S4.5T03 | −1.407 | 1.803 | −1.283 | 2.216 | −6.679 | 2.750 | 6.450 |
| S4.5T04 | −2.210 | 1.760 | −3.388 | 2.244 | −8.621 | 7.574 | 8.669 |
| S4.5T05 | −2.558 | 1.401 | −1.161 | 2.334 | −8.707 | 2.135 | 8.716 |

TABLE 4-continued

Min and Max Deflections and Rotations of Helmet 1 - Magnets

| Trial | Helmet 1 [deQ/sec] Min X | Max X | Min Y | Max Y | Min Z | Max Z | Maximum Resultant Angular Accelera-tion |
|---|---|---|---|---|---|---|---|
| S4.5T13 | −2.021 | 2.277 | −1.863 | 1.705 | −8.592 | 7.668 | 8.756 |
| S4.5T14 | −2.715 | 2.288 | −5.835 | 1.978 | −8.864 | 7.612 | 9.006 |
| S4.5T16 | −1.902 | 5.112 | −2.757 | 4.050 | −8.263 | 5.126 | 8.284 |
| S4.5T17 | −1.778 | 4.932 | −2.472 | 3.741 | −8.308 | 4.488 | 8.371 |
| S4.5T18 | −0.924 | 1.413 | −1.254 | 1.436 | −8.941 | 2.187 | 8.998 |
| S4.5T19 | −2.130 | 2.088 | −3.358 | 2.070 | −7.681 | 5.855 | 7.870 |
| S4.5T21 | −0.881 | 0.970 | −2.423 | 1.499 | −7.180 | 8.448 | 7.230 |
| S4.5T22 | −2.012 | 2.196 | −2.310 | 2.259 | −7.989 | 5.817 | 8.009 |
| S4.5T26 | −1.521 | 2.069 | −1.408 | 2.201 | −7.293 | 8.428 | 7.335 |
| S4.5T27 | −1.525 | 1.147 | −1.382 | 1.153 | −7.684 | 4.473 | 7.717 |
| S4.5T28 | −0.970 | 1.070 | −0.881 | 1.080 | −8.667 | 8.825 | 8.739 |
| S4.5T29 | −1.121 | 1.287 | −2.156 | 1.832 | −8.337 | 5.951 | 8.373 |

Figure 19:
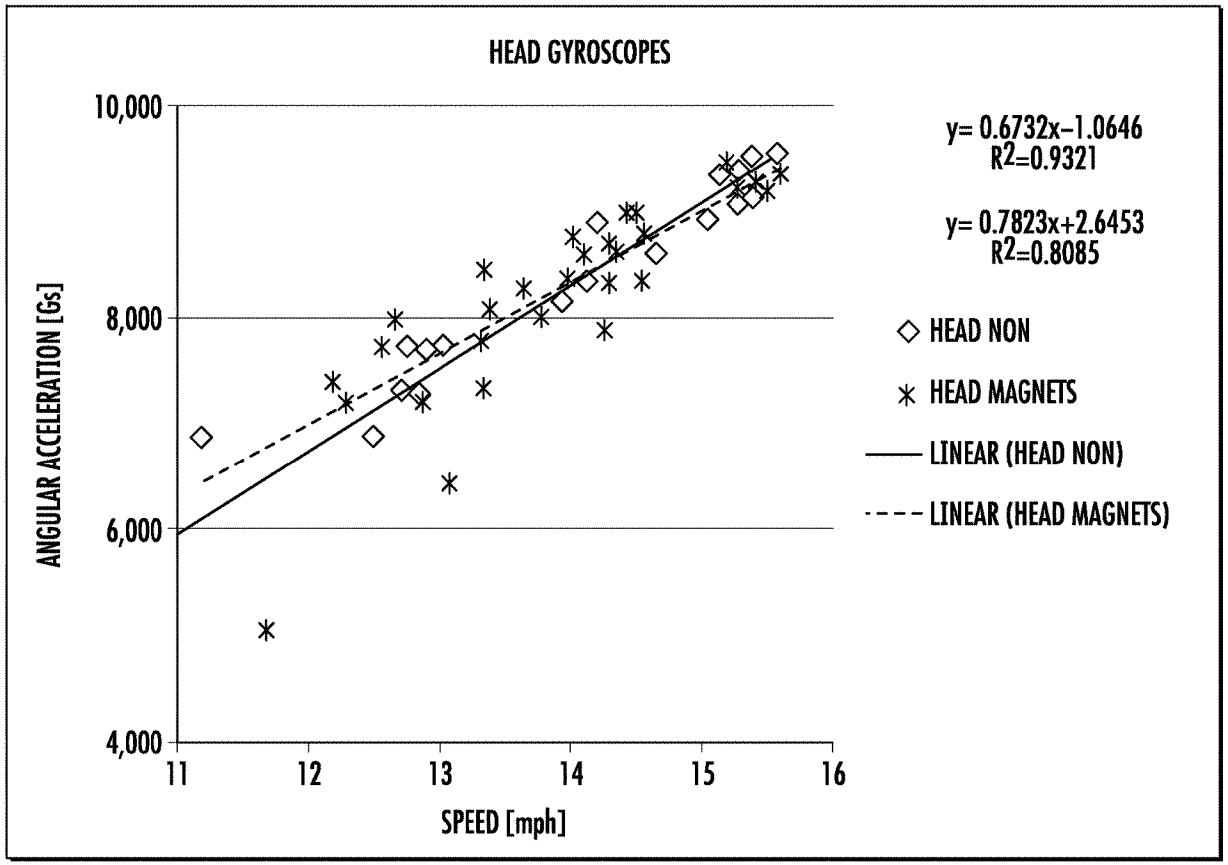
FIG. 19 is a graph of speed versus angular acceleration for the head form as measured by a gyroscope.

The results of Tables 3 and 4 are illustrated in the graph in FIG. 19 that shows output from the head gyroscope. This table illustrates data taken from the headform that would correspond to the head of the wearer 24.

Table 5 shows output data of sensor readings in the headform, the top of the helmet 12, the right side of the helmet 12, and the left side of the helmet 12. The Table 5 includes the maximum impact force of helmet 12 (linear acceleration) in Gs without magnetic components 26, 48 present.

TABLE 5

Max Impact Force of Helmet 1 (Linear Accelerations) in Gs - No Magnets

| Trial | Speed | Resultant Head Accel-eration | Resultant Top Helmet Acceleration | Resultant Right Helmet Acceleration | Resultant Left Helmet Acceleration |
|---|---|---|---|---|---|
| S14T2 | 13.02 | 64.56 | 62.65 | 64.01 | 98.70 |
| S14T3 | 12.48 | 55.12 | 65.41 | 66.89 | 80.34 |
| S14T4 | 12.71 | 58.05 | 70.99 | 62.66 | 80.59 |
| S14T6 | 14.64 | 79.46 | 91.66 | 70.24 | 95.38 |
| S14T7 | 15.38 | 95.48 | 118.22 | 76.62 | 91.37 |
| S14T10 | 14.14 | 83.77 | 94.74 | 59.08 | 72.87 |
| S14T12 | 14.2 | 85.99 | 86.85 | 67.39 | 92.90 |
| S14T13 | 12.84 | 61.50 | 69.00 | 68.30 | 73.68 |
| S14T14 | 15.03 | 92.58 | 83.21 | 85.99 | 105.49 |
| S14T15 | 15.05 | 86.35 | 84.60 | 81.08 | 106.72 |
| S14T16 | 12.95 | 65.05 | 79.09 | 73.12 | 87.91 |
| S14T17 | 15.56 | 98.86 | 97.84 | 83.92 | 91.89 |
| S14T18 | 15.27 | 88.21 | 77.00 | 81.59 | 99.44 |
| S14T19 | 15.37 | 103.19 | 88.27 | 81.42 | 108.51 |
| S8T02 | 12.76 | 62.70 | 82.61 | 60.47 | 65.53 |
| S8T03 | 11.17 | 50.25 | 58.16 | 60.57 | 61.81 |
| S8T04 | 13.93 | 70.08 | 81.28 | 69.43 | 76.21 |
| S8T13 | 15.14 | 93.62 | 109.67 | 77.85 | 92.48 |
| S8T14 | 15.27 | 114.68 | 101.79 | 81.22 | 100.46 |

The below Table 6 is the same as Table 5 with the exception that the various trials were those that did include magnetic components 26 and 48 in the helmets 12 and 34. The highest headform acceleration measured was 80.31 and thus all of the trials resulted in a force imparted to the headform that would be almost right at the concussion level limit of 80 Gs.

TABLE 6

Max Impact Force of Helmet 1 (Linear Accelerations) in Gs - Magnets

| | | Resultant | Resultant | Resultant | Resultant |
|---|---|---|---|---|---|
| S2.5T02 | 13.35 | 60.44 | 88.77 | 155.32 | 133.75 |
| S2.5T04 | 12.27 | 51.23 | 98.41 | 140.77 | 162.85 |
| S2.5T05 | 10.09 | 36.64 | 69.77 | 117.13 | 86.42. |
| S2.5T06 | 13.31 | 63.74 | 88.61 | 157.54 | 169.47 |
| S2.5T07 | 12.17 | 56.33 | 90.56 | 84.92 | 106.63 |
| S2.5T08 | 12.66 | 55.49 | 95.14 | 121.00 | 161.59 |
| S2.5T09 | 11.67 | 43.63 | 78.43 | 71.88 | 78.86 |
| S2.5T10 | 13.38 | 59.79 | 98.14 | 111.91 | 111.49 |
| S2.5T11 | 15.49 | 67.47 | 106.40 | 141.21 | 141.73 |
| S2.5T12 | 15.27 | 75.03 | 125.44 | 153.83 | 122.03 |
| S2.5T13 | 14.27 | 66.81 | 111.21 | 107.15 | 89.84 |
| S2.5T15 | 15.59 | 80.31 | 127.24 | 112.78 | 135.50 |
| S2.5T16 | 15.41 | 72.84 | 116.76 | 142.22 | 158.11 |
| S2.5T17 | 15.18 | 76.18 | 103.21 | 122.30 | 173.51 |
| S4.5T03 | 13.07 | 55.96 | 104.10 | 79.35 | 108.02 |
| S4.5T04 | 14.37 | 71.83 | 102.18 | 130.47 | 123.38 |
| S4.5T05 | 14.31 | 66.13 | 121.80 | 129.03 | 128.03 |
| S4.5T13 | 14.58 | 73.54 | 100.28 | 116.70 | 162.44 |
| S4.5T14 | 14.45 | 70.33 | 105.41 | 140.28 | 121.82 |
| S4.5T16 | 13.64 | 68.59 | 94.54 | 108.19 | 97.87 |
| S4.5T17 | 13.95 | 69.44 | 100.70 | 107.24 | 100.03 |
| S4.5T18 | 14.51 | 67.02 | 106.60 | 112.95 | 88.80 |
| S4.5T19 | 14.24 | 66.77 | 95.50 | 89.06 | 109.75 |
| S4.5T21 | 12.87 | 52.08 | 89.76 | 83.13 | 88.26 |
| S4.5T22 | 13.76 | 61.97 | 92.34 | 96.04 | 112.50 |
| S4.5T26 | 13.34 | 55.85 | 84.02 | 126.50 | 104.42 |
| S4.5T27 | 12.55 | 61.73 | 88.30 | 79.56 | 83.67 |
| S4.5T28 | 14.02 | 64,.73 | 100.75 | 85.88 | 91.22 |
| S4.5T29 | 14.54 | 59.74 | 101.12 | 98.06 | 93.98 |

The following Table 7 shows movement and angular deflection of the helmet 12 with no magnetic components 26 or 48 both pre and post impact. As used herein, Helmet 1 refers to helmet 12.

TABLE 7

Change in Position Pre and Post Impact of Helmet 1 - No Magnets

| | | Helmet 1 Pre Impact | | | Helmet 1 Post Impact | | |
|---|---|---|---|---|---|---|---|
| Trial | Speed | X (ML) | Y (AP) | Z (SI) | X (ML) | Y (AP) | Z (SI) |
| S14T2 | 13.02 | −0.12 | −39.97 | −0.52 | 16.48 | 22.76 | 29.54 |
| S14T3 | 12.48 | 0.03 | −35.96 | −0.16 | 5.14 | 137.45 | 16.89 |
| S14T4 | 12.71 | −0.50 | −34.39 | −2.11 | 14.92 | 12.59 | 22.75 |
| S14T6 | 14.64 | −0.20 | −43.54 | −0.04 | 18.61 | 57.27 | 14.63 |
| S14T7 | 15.38 | −0.15 | −45.49 | −1.04 | 23.90 | 54.18 | 11.83 |
| S14T1 | 14.14 | 0.02 | −38.93 | −0.21 | 16.23 | 61.03 | 15.27 |
| S14T1 | 14.2 | −0.43 | −40.17 | −1.30 | 13.15 | 29.43 | −11.93 |
| S14T1 | 12.84 | −0.18 | −36.34 | −0.35 | 14.69 | 16.30 | 3.51 |
| S14T14 | 15.03 | −0.11 | −40.86 | 0.49 | 14.33 | 43.26 | 6.28 |
| S14T15 | 15.05 | −0.08 | −43.39 | −0.22 | 8.33 | 13.69 | 2.73 |
| S14T16 | 12.95 | −0.34 | −39.40 | −0.16 | 11.43 | 19.86 | 12.18 |
| S14T17 | 15.56 | −0.12 | −45.79 | −0.31 | 13.49 | 62.38 | 22.52 |
| S14T18 | 15.27 | −0.09 | −46.18 | −1.31 | 39.95 | 27.25 | 19.22 |
| S14T19 | 15.37 | 0.15 | −45.87 | 0.14 | 16.70 | 71.98 | 13.03 |
| S8T02 | 12.76 | −0.21 | −38.92 | −0.86 | 2.23 | −35.35 | 7.57 |
| S8T03 | 11.17 | −0.69 | −36.80 | 0.05 | 16.26 | −27.84 | 12.43 |
| S8T04 | 13.93 | −0.11 | −43.18 | 0.71 | 18.54 | 0.11 | 14.59 |
| S8T13 | 15.14 | −0.16 | −43.37 | 0.34 | 13.56 | 72.42 | 18.94 |
| S8T14 | 15.27 | −0.45 | −44.75 | 0.76 | 41.65 | 42.49 | 20.60 |

Table 8 is the same as Table 7 but with runs in which the helmets 12 and 34 do include magnetic components 26 and 48.

TABLE 8

Change in Position Pre and Post Impact of Helmet 1 - Magnets

| Trial | Speed | Helmet 1 Pre Impact [mm] X (ML) | Y (AP) | Z (SI) | Helmet 1 Post Impact [mm] X (ML) | Y (AP) | Z (SI) |
|---|---|---|---|---|---|---|---|
| S2.5T0 | 13.35 | 0.71 | 38.68 | 0.61 | 17.66 | −129.67 | 78.27 |
| S2.5T0 | 12.27 | 0.74 | 37.98 | −0.17 | 16.68 | −82.47 | 58.21 |
| S2.5T0 | 10.09 | −0.40 | 39.73 | −0.01 | 0.35 | 3.18 | −0.08 |
| S2.5T0 | 13.31 | 0.94 | 40.08 | −1.10 | 17.70 | −113.32 | 69.16 |
| S2.5T0 | 12.17 | 0.47 | 40.43 | 0.51 | 18.05 | −87.11 | 58.24 |
| S2.5T0 | 12.66 | 0.26 | 40.40 | 0.98 | 19.73 | −92.89 | 65.99 |
| S2.5T0 | 11.67 | −0.24 | 29.60 | −3.12 | 2.69 | −141.23 | 70.32 |
| S2.5T1 | 13.38 | 0.14 | 37.29 | −1.02 | 9.89 | −110.91 | 56.38 |
| S2.5T1 | 15.49 | −0.40 | 43.72 | −0.88 | −1.32 | −121.51 | 60.76 |
| S2.5T1 | 15.27 | −0.01 | 42.76 | −0.47 | 2.72 | −131.36 | 63.94 |
| S2.5T1 | 14.27 | 0.54 | 40.31 | −1.68 | 13.10 | −136.39 | 73.52 |
| S2.5T1 | 15.59 | 0.95 | 44.51 | −0.07 | 10.26 | −127.59 | 58.34 |
| S2.5T1 | 15.41 | 0.54 | 42.35 | −0.66 | 9.46 | −120.76 | 65.55 |
| S2.5T1 | 15.18 | 0.63 | 44.01 | 0.27 | 13.41 | −121.89 | 65.52 |
| S4.5T0 | 13.07 | −0.60 | 39.02 | 1.69 | 5.80 | −60.78 | 50.40 |
| S4.5T0 | 14.37 | 0.18 | 41.19 | 0.72 | 18.61 | −116.69 | 63.93 |
| S4.5T0 | 14.31 | −0.90 | 41.61 | 0.32 | 3.34 | −129.60 | 67.53 |
| S4.5T1 | 14.58 | 0.12 | 41.91 | −0.11 | 19.74 | −123.60 | 71.59 |
| S4.5T1 | 14.45 | 0.45 | 41.40 | −0.13 | 22.86 | −124.31 | 70.89 |
| S4.5T1 | 13.64 | −0.72 | 37.12 | −2.09 | 10.71 | −137.48 | 80.30 |
| S4.5T1 | 13.95 | −0.22 | 41.51 | −1.01 | 6.80 | −140.97 | 78.73 |
| S4.5T1 | 14.51 | 0.11 | 38.69 | −0.65 | 8.53 | −149.01 | 72.04 |
| S4.5T1 | 14.24 | 0.06 | 41.31 | −1.40 | 9.78 | −96.29 | 56.20 |
| S4.5T2 | 12.87 | −0.94 | 36.83 | −1.71 | 3.46 | −97.42 | 73.50 |
| S4.5T2 | 13.76 | −0.31 | 33.51 | −1.76 | 7.00 | −43.61 | 35.33 |
| S4.5T2 | 13.34 | −0.59 | 32.19 | −2.77 | 9.32 | −126.72 | 81.12 |
| S4.5T2 | 12.55 | −0.61 | 35.40 | −0.90 | 4.68 | −138.09 | 71.26 |
| S4.5T2 | 14.02 | −0.18 | 38.04 | −0.84 | 11.99 | −99.11 | 56.53 |
| S4.5T2 | 14.54 | −0.58 | 38.62 | −2.69 | 5.41 | −140.02 | 74.24 |

The changes in helmet 12 deflections pre impact and post impact is disclosed in Table 9 in which no magnetic components 26, 48 are present.

TABLE 9

Change in Helmet Deflections Pre and Post Impact - No Magnets

| Trial | Delta Helmet Pre Impact [deg] | Delta Helmet Post Impact [deg] | Delta Helmet Twist Pre Impact [deg] | Delta Helmet Twist Post Impact [deg] |
|---|---|---|---|---|
| S14T2 | 1.24 | −4.75 | 0.13 | −1.62 |
| S14T3 | 0.22 | −1.35 | −0.06 | −1.31 |
| S14T4 | 0.40 | −0.15 | 0.10 | −1.09 |
| S14T6 | 0.55 | −2.32 | 0.00 | −0.72 |
| S14T7 | −0.14 | −0.49 | −0.02 | −0.24 |
| S14T10 | 0.61 | −1.67 | −0.14 | −0.48 |
| S14T12 | −0.95 | 2.65 | 0.07 | −0.59 |
| S14T13 | 0.17 | −0.39 | −0.10 | −5.58 |
| S14T14 | 0.31 | 0.07 | −0.15 | −6.83 |
| S14T15 | 0.08 | 4.46 | −0.04 | −0.75 |
| S14T16 | −0.82 | 1.04 | 0.10 | −0.57 |
| S14T17 | −0.74 | 3.67 | −0.09 | −0.35 |
| S14T18 | −0.42 | −4.08 | −0.09 | −0.57 |
| S14T19 | −0.74 | 1.88 | −0.05 | −0.69 |
| S8T02 | −0.95 | 6.10 | 0.16 | 0.13 |
| S8T03 | −0.28 | −5.02 | −0.08 | −1.11 |
| S8T04 | −0.03 | −0.05 | −0.03 | −0.84 |
| S8T13 | −0.50 | 2.72 | −0.01 | 0.13 |
| S8T14 | −1.09 | −2.66 | −0.05 | 0.17 |

Table 10 below is the same as Table 9 with the exception that the magnetic components 26, 48 are present in helmets 12 and 34.

TABLE 10

Change in Helmet Deflections Pre and Post Impact - Magnets

| Trial | Delta Helmet Pre Impact [deg] | Delta Helmet Post Impact [deg] | Delta Helmet Twist Pre Impact [deg] | Delta Helmet Twist Post Impact [deg] |
|---|---|---|---|---|
| S2.5T02 | 2.91 | −0.09 | 0.01 | −1.64 |
| S2.5T04 | 1.95 | 2.35 | 0.35 | −1.01 |
| S2.5T05 | −0.34 | 0.12 | −0.17 | −0.16 |
| S2.5T06 | 2.49 | 0.48 | 0.26 | −0.56 |
| S2.5T07 | 1.66 | 2.69 | 0.14 | −0.98 |
| S2.5T08 | 1.86 | 2.82 | 0.23 | −0.69 |
| S2.5T09 | 0.50 | 1.06 | −0.35 | −6.59 |
| S2.5T10 | 0.63 | 1.86 | −0.11 | −4.89 |
| S2.5T11 | −0.83 | 1.46 | −0.31 | −4.71 |
| S2.5T12 | 0.01 | 1.71 | −0.20 | −1.97 |
| S2.5T13 | 1.28 | 2.35 | −0.06 | −1.68 |
| S2.5T15 | 2.83 | −0.80 | −0.14 | −0.75 |
| S2.5T16 | 1.70 | 0.37 | −0.37 | −0.40 |
| S2.5T17 | 2.00 | 1.22 | 0.02 | −0.25 |
| S4.5T03 | 0.53 | −0.93 | −0.02 | −0.47 |
| S4.5T04 | 2.22 | 1.28 | 0.28 | −2.27 |
| S4.5T05 | −0.23 | 0.82 | 0.13 | −0.62 |
| S4.5T13 | 1.75 | 1.70 | 0.35 | −1.44 |
| S4.5T14 | 2.06 | 2.44 | 0.07 | −1.25 |
| S4.5T16 | 0.76 | 0.28 | 0.36 | −0.48 |
| S4.5T17 | 0.88 | 0.10 | 0.13 | −3.56 |
| S4.5T18 | 0.75 | 0.51 | 0.61 | 0.84 |
| S4.5T19 | 1.61 | 0.22 | −0.58 | 0.00 |
| S4.5T21 | 0.24 | 0.07 | 0.04 | 1.91 |
| S4.5T22 | 0.56 | 0.99 | 0.30 | 8.98 |
| S4.5T26 | 0.36 | 1.19 | 0.71 | −2.22 |
| S4.5T27 | −0.75 | 2.33 | −0.44 | 0.70 |
| S4.5T28 | −0.14 | 3.76 | 0.57 | 0.65 |
| S4.5T29 | −0.21 | 0.83 | 0.69 | 1.47 |

Figure 20:
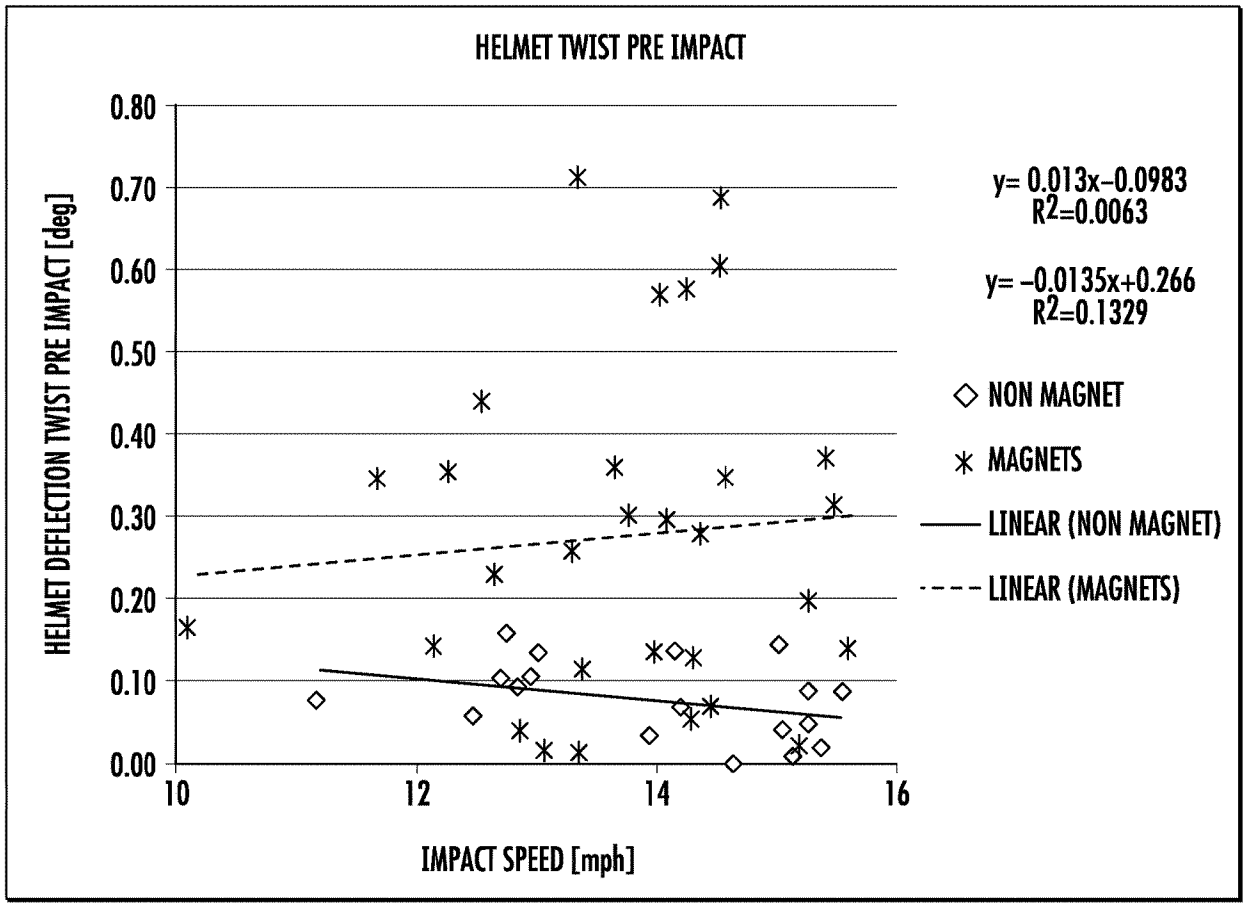
FIG. 20 is a graph of impact speed versus helmet deflection twist pre-impact.

The helmet 12 twist results are illustrated with reference to FIG. 20 in which the helmet 12 twist pre-impact in degrees vs. speed is shown. The trials with the magnetic components 26, 48 had a higher degree of twist than those without the magnetic components 26, 48. The faster the speed, the greater the amount of twist that occurred for those with the magnetic components 26, 48, and the faster the speed the lesser amount of helmet 12 twist was observed for those helmets 12 that did not have the magnetic components 26, 48.

The changes in the neck deflections of the model both pre-impact and post-impact were likewise measured in the experiments and the results with no magnetic components 26, 48 present are illustrated below in Table 11.

TABLE 11

Change in Neck Deflections Pre and Post Impact - No Magnets

| Trial | Delta Neck Pre Impact [deg] | Delta Neck Post Impact [deg] |
|---|---|---|
| S14T2 | −0.03 | 37.09 |
| S14T3 | 0.04 | 36.21 |
| S14T4 | 0.31 | 35.17 |
| S14T6 | 0.32 | 37.05 |
| S14T7 | −0.32 | 41.02 |
| S14T10 | −0.05 | 38.47 |
| S14T12 | 0.19 | 39.03 |
| S14T13 | −0.25 | 37.80 |
| S14T14 | 0.34 | 41.88 |
| S14T15 | 0.25 | 40.68 |
| S14T16 | 0.04 | 34.79 |
| S14T17 | 0.02 | 44.47 |
| S14T18 | −0.52 | 41.09 |
| S14T19 | −0.21 | 45.80 |

TABLE 11-continued

| Change in Neck Deflections Pre and Post Impact - No Magnets | | |
|---|---|---|
| Trial | Delta Neck Pre Impact [deg] | Delta Neck Post Impact [deg] |
| S8T02 | −0.03 | 37.09 |
| S8T03 | 0.04 | 36.21 |
| S8T04 | 0.31 | 35.17 |
| S8T13 | 0.32 | 37.05 |
| S8T14 | −0.32 | 41.02 |

Still further, the changes in neck deflections both pre-impact and post-impact were recorded for impacts in which the helmet 12 had the magnetic component 26 and was impacted with the helmet 34 that likewise included a magnetic component 48. This data is displayed in Table 12 below.

TABLE 12

| Change in Neck Deflections Pre and Post Impact - Magnets | | |
|---|---|---|
| Trial | Delta Neck Pre Impact [deg] | Delta Neck Post Impact [deg] |
| S2.5T02 | 0.64 | 23.39 |
| S2.5T04 | −0.15 | 18.95 |
| S2.5T05 | 0.65 | 0.61 |
| S2.5T06 | 0.22 | 21.41 |
| S2.5T07 | 0.00 | 21.61 |
| S2.5T08 | 0.55 | 21.61 |
| S2.5T09 | −0.21 | 17.13 |
| S2.5T10 | 0.82 | 22.72 |
| S2.5T11 | 0.83 | 25.91 |
| S2.5T12 | 0.67 | 24.82 |
| S2.5T13 | 0.15 | 23.38 |
| S2.5T15 | 0.53 | 26.18 |
| S2.5T16 | 0.69 | 24.75 |
| S2.5T17 | 0.48 | 24.85 |
| S4.5T03 | 1.64 | 14.25 |
| S4.5T04 | 0.44 | 22.07 |
| S4.5T05 | 0.92 | 23.85 |
| S4.5T13 | 0.07 | 23.46 |
| S4.5T14 | 0.66 | 23.64 |
| S4.5T16 | −0.08 | 22.84 |
| S4.5T17 | −0.21 | 25.46 |
| S4.5T18 | 0.62 | 25.65 |
| S4.5T19 | 1.15 | 21.34 |
| S4.5T21 | 0.58 | 20.77 |
| S4.5T22 | 1.38 | 11.64 |
| S4.5T26 | 0.75 | 20.61 |
| S4.5T27 | −1.21 | 24.93 |
| S4.5T28 | 1.06 | 23.72 |
| S4.5T29 | 0.77 | 22.30 |

Figure 21:
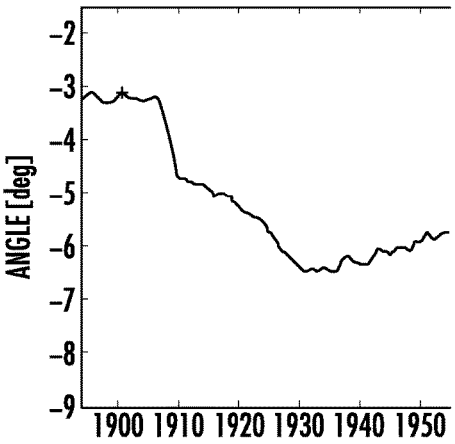
FIG. 21 is a plot of helmet impact without magnet components that shows helmet twist pre- and post-impact.
Figure 22:
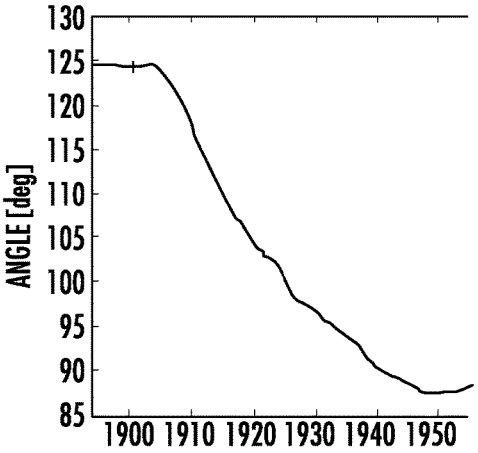
FIG. 22 is a plot of helmet impacts without magnet components that shows neck movement pre- and post-impact.

Helmet 12 twisting and neck movement from impacts that do not include the first and second magnetic components 26 and 48 are shown with reference to FIGS. 21 and 22. The frames of motion capture are listed on the X axis, and the helmets 12, 34 that impact one another are from the (S12T2) trial in which the helmets 12, 34 were moving at a speed of 13.02 mph. As shown with reference to FIG. 21, there is not a significant helmet 12 twist (ears angle) before impact which is illustrated at approximately frame 1902 by the asterisk which denotes the impact frame. FIG. 22 shows the neck flexion angle and a significant change in the neck flexion angle is noted after the point of impact denoted by the asterisk.

Figure 23:
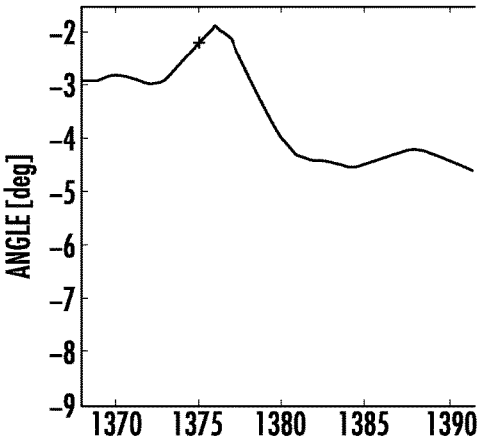
FIG. 23 is a plot of helmet impact with magnet components that shows helmet twist pre- and post-impact.
Figure 24:
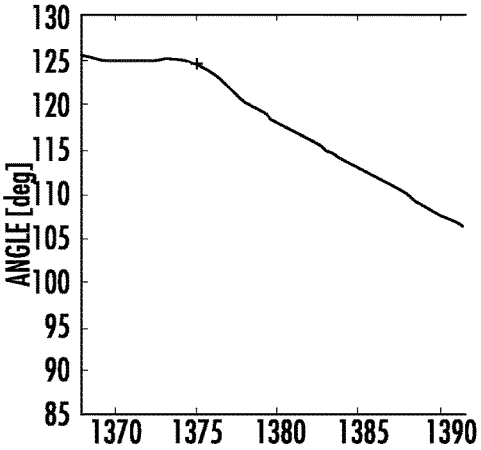
FIG. 24 is a plot of helmet impact with magnet components that shows neck movement pre- and post-impact.

FIGS. 23 and 24 show impact in which the helmets 12, 34 include the magnetic components 26 and 48 during the trial (S4.5T22) in which the helmet 12, 34 speed was 13.76 mph. The frames of motion capture are on the X-axes and the frame of impact is denoted with the asterisks and occur at approximately frame 1376. FIG. 23 shows the helmet 12 twist (ears angle) and it can be seen that the helmet 12 twists approximately 0.6 degrees before impact. However, the post-impact twist is not quite as much in magnitude as that shown in FIG. 21, but displays a general pattern that is approximately the same. FIG. 24 shows the neck flexion angle pre and post-impact and the degree of flex is less that that shown in FIG. 22 in which no magnetic components 26, 48 were present.

Experiments were also conducted in which the strength of the magnetic components 26, 48 were increased and it was discovered that this likewise effected the amount of linear acceleration experienced on the helmets 12, 34, and also on the linear resultant inside of the headform. The amount of Gs sensed by the headform would be a direct estimation of the potential for concussion as the sensor is located inside of the head of the wearer 24. The results of the various experiments shows that as the speed of the helmets 12, 34 at impact increase, the amount of linear accelerations and thus the potential for concussion increase. For higher impact velocities between 14 and 16 mph, the results of the experiments show that helmets 12, 34 with magnetic components 26, 48 reduce resultant linear accelerations by approximately 20 Gs from an average of 92.93 G for a helmet 12 without a magnetic component 26 to 69.33 G for a helmet 12 with a magnetic component 26. This reduction moves the average impact for a crown to crown hit to below 80 G which is the point at which concussions are normally experienced. There was a slight increase in the motion of the helmets 12 pre-impact when having the magnetic component 26. On average, the helmet 12 with the magnetic component 26 twisted in the transverse plane approximately 0.2 degrees more than helmets 12 that did not include the magnetic component 26.

Figure 25:
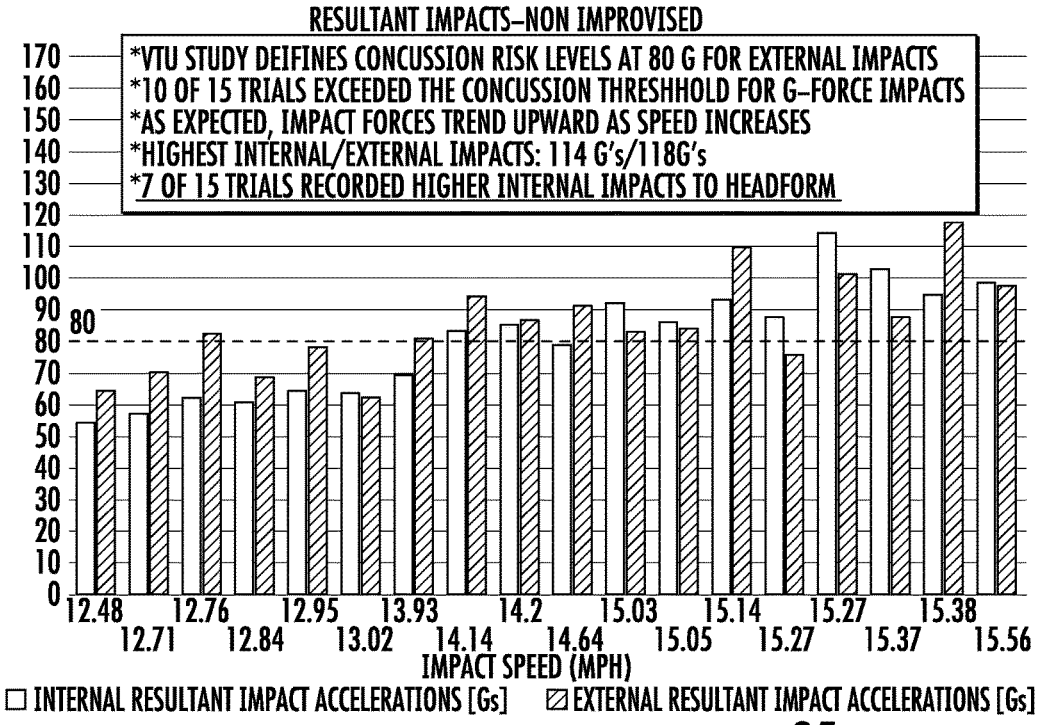
FIG. 25 is a graph of impact speed versus impact acceleration for helmets with no magnetic components as measured both in the head form and on the top of the helmet.

FIG. 25 shows experimental results for helmets 12, 34 that do not include the magnetic components 26, 48. The impact speeds are charted on the X-axis and the impact accelerations in Gs are on the Y-axis. The accelerations were measured by sensors in the headform and on the top of the helmet 12. The sensor in the headform is listed as internal resultant impact acceleration in FIG. 25, and the sensor at the top of helmet 12 is listed as external resultant impact acceleration. Ten of the fifteen trials exceeded the concussion threshold of 80 G for the observed impacts. Expectedly, the measured external impact forces moved upwards as speed increases. Seven of the fifteen measured collisions have higher internal accelerations than external accelerations which means that the headform, and thus head, of the wearer would be subjected to as much acceleration as the helmet 12.

Figure 26:
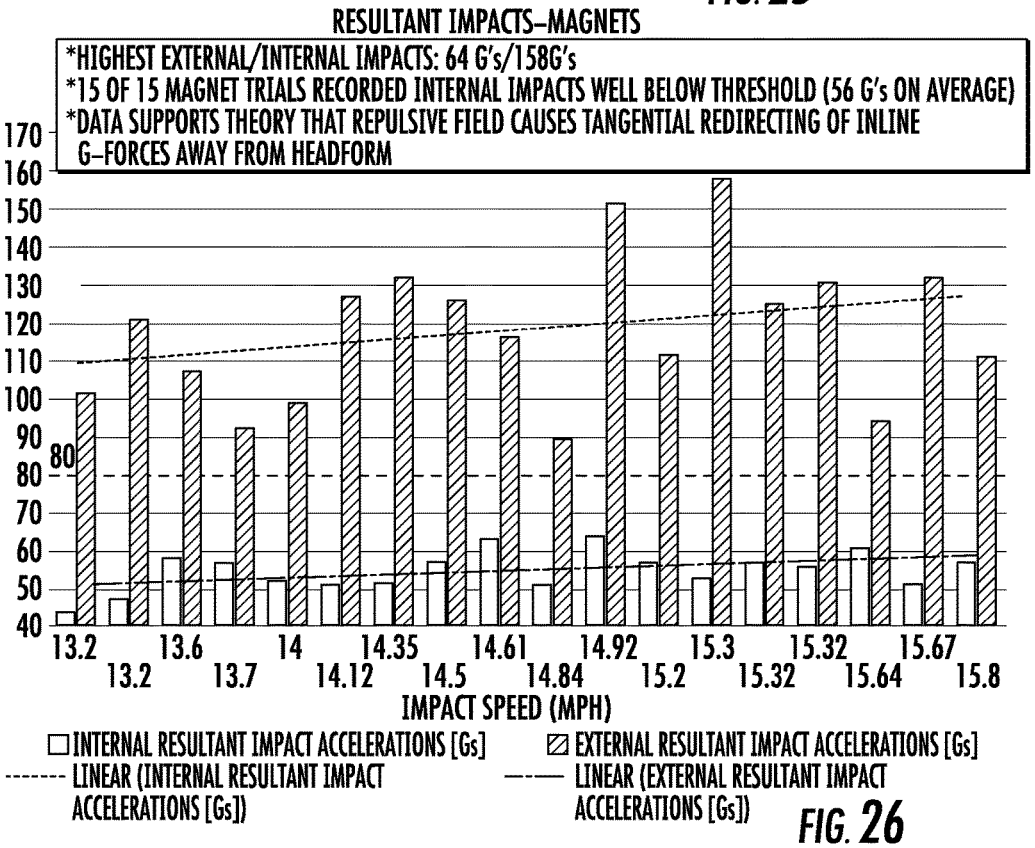
FIG. 26 is a graph of impact speed versus impact acceleration for helmets that have magnet components as measured by sensors in the head form and on the top of the helmet.

FIG. 26 is a graph of the experiments in which the helmets 12, 34 both include the magnetic components 26, 48 in which speed of impact is on the X-axis and the impact acceleration is on the Y-axis. Measurements from the sensor on the top of the helmet 12, external resultant impact acceleration, were compared to those of sensor measurements in the headform, internal resultant impact acceleration. This data shows the effect of the collision on the head of the wearer 24. The highest external resultant impact was about 158 Gs, and the highest measured internal resultant impact was about 64 Gs. All fifteen of the measured trials resulted in an internal (headform) measured acceleration that were all below the 80 G threshold, and the average was about 56 Gs. These measurements support the theory that the repulsive magnetic field causes tangential redirecting of the inline G forces away from the headform.

Figure 27:
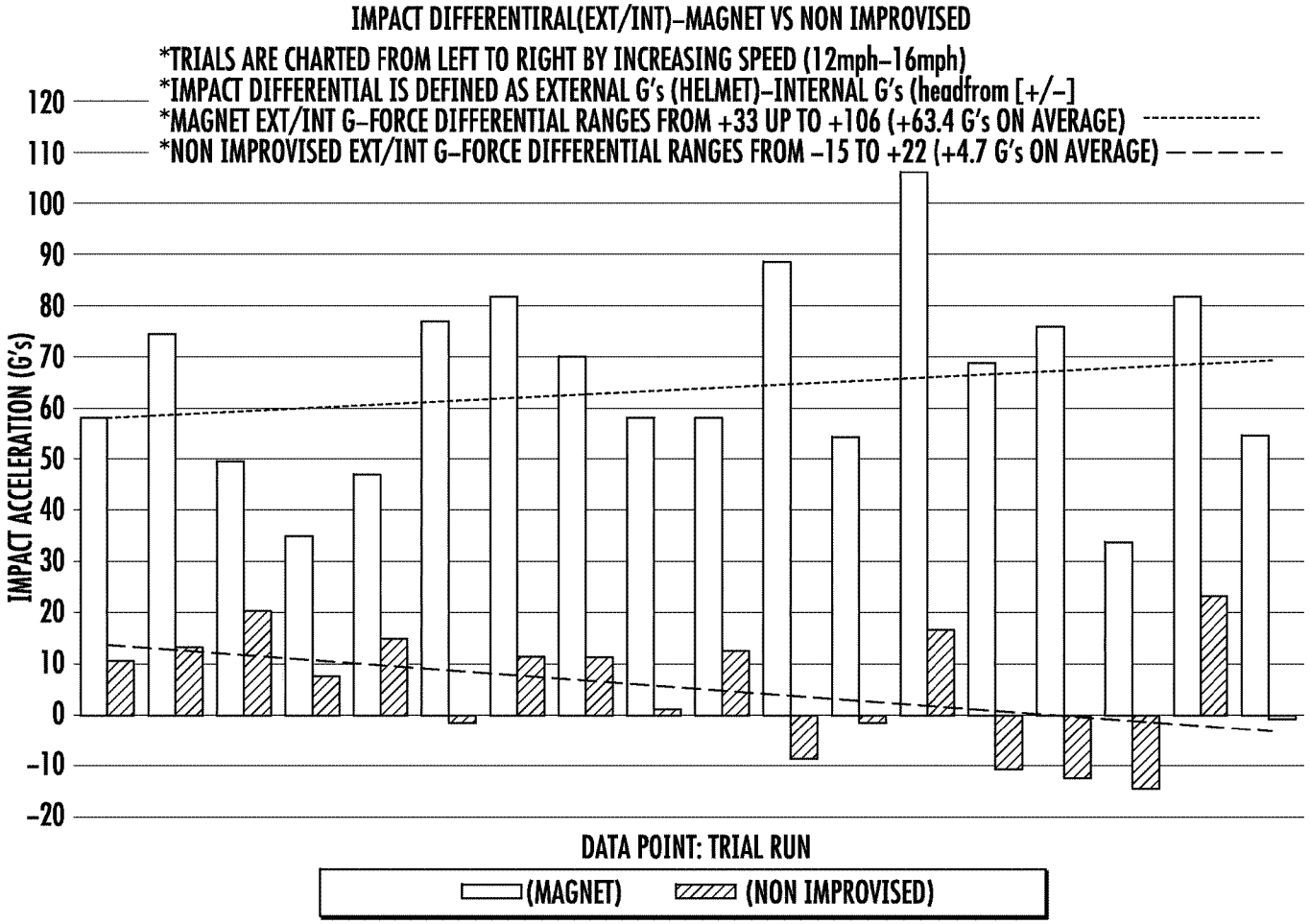
FIG. 27 is a graph of impact speeds versus impact acceleration that shows the impact differential for impacts having magnet components and for impacts in which the helmets do not include magnet components.

FIG. 27 is a graph that compares the magnetic component 26, 48 impacts with the non-magnetic component 26, 48 impacts. The speeds were from 12-16 and are charted on the X-axis from left to right. Impact differential is defined as external G's (measured at the top of the helmet) minus the internal Gs (measured in the headform). The trials with the magnetic components 26, 48 have an external/internal G-force differential that ranges from +33 to +106 with an average of +63.4 Gs. The experiments without the magnetic components 26, 48 have an external/internal G-force differential range from −15 to +22 with an average of +4.7 Gs.

It was found that externally measured linear accelerations have a better correlation to internal headform measurements than rotational accelerations. While existing external field and laboratory measurements may be flawed, they are likely correlated to what is occurring biomechanically on the helmet 12 and inside the headform.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A helmet for reducing impact forces on an interior of said helmet, said helmet comprising:

a top and opposite bottom of said helmet;

a front side and opposite back side of said helmet;

a central axis extending between said top and bottom of said helmet, and located medially between said front and back sides of said helmet;

a longitudinal axis extending between said front and back sides of said helmet and intersecting said central axis at a perpendicular angle;

an inner surface defining an interior of said helmet, and an opposite exterior surface;

a frontal section located on said front side, forward of said central axis and centered on said longitudinal axis, and substantially covering a frontal bone of a wearer when worn; and a magnet component centrally located on and secured to said frontal section, said magnet component extending across said frontal section circumferentially at least 90 degrees around said central axis, said magnet component having a first side emitting a magnetic force of a first polarity and an opposite second side emitting a magnetic force of an opposite second polarity, said first side facing said exterior surface of said helmet and emitting said magnetic force of said first polarity radially outwardly from said helmet in a continuous magnetic field sufficient to reduce the impact force of a like helmet having a like polarity to less than 80 G's when a speed in the range of 13-16 mph is applied to each such helmet.

2. The helmet as set forth in claim 1, wherein said magnet component is a single magnet.

3. The helmet as set forth in claim 1, wherein said magnet component is made up of a plurality of individual magnets.

4. The helmet as set forth in claim 1, wherein said magnet component is located on said exterior surface of said helmet.

5. The helmet as set forth in claim 1, wherein said magnet component extends at least 180 degrees around said central axis of the said helmet, said helmet further having a right parietal section covering a right parietal bone of the wearer of said helmet when worn and a left parietal section covering a left parietal bone of the wearer of said helmet when worn, wherein said magnet component is located at said right parietal section and said left parietal section of said helmet.

6. The helmet as set forth in claim 1, further comprising a housing completely encasing said magnet component.

7. The helmet as set forth in claim 6, wherein said helmet further includes a shell forming at least a portion of said housing, wherein said exterior surface of said helmet is located on said shell.

8. A headgear system, comprising:

a first helmet having a central axis, an inner surface defining an interior of said first helmet, an opposite exterior surface, and a frontal section covering a frontal bone of a wearer of said first helmet when worn;

said first helmet further including a face guard and a protrusion located at said frontal section of said first helmet and forward of said face guard in a longitudinal direction at a longitudinal centerline of said first helmet, said protrusion extending in a longitudinal direction of said first helmet;

a first magnet component secured to said frontal section of said first helmet at said protrusion, said first magnet component emitting a first magnetic force in a direction away from said interior of said first helmet, said first magnet component extending at least 90 degrees around said central axis of said first helmet;

a second helmet having a central axis, an inner surface defining an interior of said second helmet, an opposite exterior surface, and a frontal section covering a frontal bone of a wearer of said second helmet when worn;

a second magnet component secured to said frontal section of said second helmet, said second magnet component emitting a second magnetic force in a direction away from said interior of said second helmet, said second magnet component extending at least 90 degrees around said central axis of said second helmet; and said first and second magnetic forces repelling one another when said first and second magnet components are located proximate to one another.

9. The headgear system as set forth in claim 8, wherein said protrusion extends at least 90 degrees around said central axis of said first helmet, said first helmet further including a first shell, wherein said exterior surface of said first helmet is located on said first shell and said protrusion.

10. The helmet as set forth in claim 1, wherein said first magnet component is spaced apart from and angled by at least 30 degrees with respect to said central axis; and wherein said first magnet component has a residual induction BR property of at least 14,200 Gauss.

11. A headgear system for reducing impact forces in collisions, comprising:

a plurality of helmets, each having:

(i) a top and opposite bottom;

(ii) a front side and opposite back side;

(iii) a central axis extending between said top and bottom of said helmet, and located medially between said front and back sides of said helmet;

(iv) a longitudinal axis extending between said front and back sides of said helmet and intersecting said central axis at a perpendicular angle;

(v) an inner surface defining an interior of said helmet and an opposite exterior surface;

(vi) a frontal section located on said front side, forward of said central axis and centered on said longitudinal axis, and substantially covering a frontal bone of a wearer when worn; and (vii) a magnet component centrally located on and secured to said frontal section, said magnet component extending across said frontal section circumferentially at least 90 degrees around said central axis, said magnet component having a first side emitting a magnetic force of a first polarity and an opposite second side emitting a magnetic force of an opposite second polarity, said first side facing said exterior surface of said helmet;

said magnet components of each of said plurality of helmets emitting a said magnetic force of said first polarity radially outwardly from each of said plurality of helmets in a continuous magnetic field sufficient to reduce the impact force on said inner surfaces of a first and second such helmet impacting each other to less than 80 G's when a speed in the range of 13-16 mph is applied to each of said first and second helmets.

12. A headgear system, comprising:

a first helmet having a central axis, an inner surface defining an interior of said first helmet, an opposite exterior surface, a frontal section covering a frontal bone of a wearer of said first helmet when worn, and a first shell;

a first housing located at said frontal section of said first helmet;

a first magnet component completely encased in said first housing and emitting a first magnetic force in a direction away from said interior of said first helmet;

said first magnet component and said first housing extending at least 90 degrees around said central axis of said first helmet;

a second helmet having a central axis, an inner surface defining an interior of said second helmet, an opposite exterior surface, a frontal section covering a frontal bone of a wearer of said second helmet when worn and a second shell;

a second housing located at said frontal section of said second helmet;

a second magnet component completely encased in said second housing and emitting a second magnetic force in a direction away from said interior of said second helmet;

said second housing and said second magnet component extending at least 90 degrees around said central axis of the said second helmet; and said first and second magnetic forces repelling one another when said first and second magnet components are located proximate to one another.

13. The headgear system as set forth in claim 11, wherein each of said plurality of helmets further including a housing completely encasing said magnet component, and a shell, wherein said shell and said housing are integrally formed with one another where said magnet component is encased.

14. The headgear system as set forth in claim 13, wherein said housing and said shell are separate components attached to one another.

15. The headgear system as set forth in claim 13, wherein said shell forms a portion of said housing, and said housing includes a separate component attached to said shell such that said housing is formed by both said separate component and said shell.

16. A headgear system, comprising:

a first helmet having a central axis, an inner surface defining an interior of said first helmet, an opposite exterior surface, a frontal section covering a frontal bone of a wearer of said first helmet when worn, and a first shell;

said first helmet further including a face guard and a protrusion located at said frontal section of said first helmet and forward of said face guard in a longitudinal direction at a longitudinal centerline of said first helmet, said protrusion extending at least 90 degrees around said central axis of said first helmet, said first shell and said protrusion are located on said exterior surface of said first helmet;

a first magnet component located at said protrusion of said first helmet, said first magnet component emitting a first magnetic force in a direction away from said interior of said first helmet;

a first housing completely encasing said first magnet component;

a second helmet having a central axis, an inner surface defining an interior of said second helmet, an opposite exterior surface, a second shell;

a second magnet component secured to said second helmet, said second magnet component emitting a second magnetic force in a direction away from said interior of said second helmet; and said first and second magnetic forces repelling one another when said first and second magnet components are located proximate to one another.

17. The headgear system as set forth in claim 11, wherein said magnet component is spaced apart and angles by at least 30 degrees with respect to said central axis of each of said plurality of helmets; and wherein said magnet component in each of said plurality of helmets has a residual induction BR property of at least 14,200 Gauss.

18. A headgear system, comprising:

a first helmet that has a central axis, wherein the first helmet has an inner surface that defines an interior of the first helmet, wherein the first helmet has a first shell that has an exterior surface, wherein the first helmet has a frontal bone section that covers a frontal bone of a wearer of the first helmet, wherein the first helmet has a first protrusion that extends from the exterior surface of the first shell in a direction away from the interior of the first helmet;

a first magnet component located at the first protrusion, wherein the first magnet component is located at the frontal bone section of the first helmet, wherein the first magnet component emits a first magnet force in a direction away from the interior of the first helmet;

a second helmet that has a central axis, wherein the second helmet has an inner surface that defines an interior of the second helmet, wherein the second helmet has a second shell that has an exterior surface, wherein the second helmet has a frontal bone section that covers a frontal bone of a wearer of the second helmet, wherein the second helmet has a second protrusion that extends from the exterior surface of the second shell in a direction away from the interior of the second helmet; and a second magnet component located at the second protrusion, wherein the second magnet component is located at the frontal bone section of the second helmet, wherein the second magnet component emits a second magnet force in a direction away from the interior of the second helmet;

wherein the first magnet force and the second magnet force repel one another when the first and second magnet components are located proximate to one another.

19. The headgear system as set forth in claim 18, wherein the first magnet component and the first protrusion extend at least 90 degrees around the central axis of the first helmet;

wherein the second magnet component and the second protrusion extend at least 90 degrees around the central axis of the second helmet.

20. The headgear system as set forth in claim 19, wherein the first magnet component is a single magnet, and wherein the second magnet component is a single magnet; and further comprising a first housing that completely encases the first magnet component.

21. The headgear system as set forth in claim 18, wherein the first helmet has a face guard, wherein the protrusion extends in a longitudinal direction of the first helmet, wherein the protrusion is located at the frontal bone section of the first helmet, wherein the protrusion is located forward of the face guard in the longitudinal direction at a longitudinal centerline of the first helmet.

22. The headgear system as set forth in claim 18, wherein the first protrusion has an exterior surface, wherein the exterior surface of the first shell and the exterior surface of the first protrusion are both located on an exterior surface of the first helmet.

23. The headgear system as set forth in claim 18, wherein the first magnet component is located at an angle of at least 30 degrees from the central axis of the first helmet such that no magnets are present at the frontal bone section in a zone from the central axis of the first helmet to 30 degrees from the central axis of the first helmet; and wherein the first magnet component has a residual induction BR property of at least 14,200 Gauss.

24. The headgear system as set forth in claim 18, wherein the first helmet and the second helmet are helmets used in a sport consisting of football, hockey, lacrosse, and auto racing.

25. The headgear system as set forth in claim 8, wherein said first magnet component is a single magnet.

26. The headgear system as set forth in claim 8, wherein said first magnet component is made up of a plurality of individual magnets.

27. The headgear system as set forth in claim 8, wherein said first magnet component is located on said exterior surface of said first helmet.

28. The headgear s stem as set forth in claim 8, wherein said first magnet component extends at least 180 degrees around said central axis of said first helmet, said first helmet further having a right parietal section covering a right parietal bone of the wearer of said first helmet when worn and a left parietal section covering a left parietal bone of the wearer of said first helmet when worn, wherein said first magnet component is located at said right parietal section and said left parietal section of said first helmet.

29. The headgear system as set forth in claim 8, further comprising a first housing completely encasing said first magnet component.

30. The headgear system as set forth in claim 29, wherein the first helmet further includes a first shell forming at least a portion of said first housing, wherein said exterior surface of said first helmet is located on said first shell.

31. The headgear system as set forth in claim 8, wherein said first magnet component is spaced apart from and angled by at least 30 degrees with respect to said central axis; and wherein said first magnet component has a residual induction BR property of at least 14,200 Gauss.

32. The headgear system as set forth in claim 12, wherein said first shell and said first housing are integrally formed with one another where said first magnet component is encased.

33. The headgear system as set forth in claim 12, wherein said first housing and said first shell are separate components attached to one another.

34. The headgear system as set forth in claim 12, wherein said first shell forms a portion of said first housing, and said first housing includes a separate component attached to said first shell such that said first housing is formed b both said separate component and said first shell.

35. The headgear system as set forth in claim 12, wherein said first magnet component is spaced apart from and angled by at least 30 degrees with respect to said central axis of said first helmet; and wherein said first magnet component has a residual induction BR property of at least 14,200 Gauss.

36. The headgear system as set forth in claim 16, wherein said first shell and said first housing are integrally formed with one another where said first magnet component is encased.

37. The headgear system as set forth in claim 16, wherein said first housing and said first shell are separate components attached to one another.

38. The headgear system as set forth in claim 16, wherein said first shell forms a portion of said first housing, and said first housing includes a separate component attached to said first shell such that said first housing is formed by both said separate component and said first shell.

39. The headgear system as set forth in claim 16, wherein said first magnet component is spaced apart from and angled by at least 30 degrees with respect to said central axis of said first helmet; and wherein said first magnet component has a residual induction BR property of at least 14,200 Gauss.

40. The helmet as set forth in claim 1, wherein said magnet component emits said magnetic force of said first polarity radially outwardly from said helmet sufficient to reduce the impact force of a like helmet having a like polarity by an amount in the range of 11 to 37 G's compared to a helmet lacking said magnet component.

41. The helmet as recited in claim 1, wherein said magnet component has a magnet strength equivalent to a neodymium magnet having a grade in the range of N-35 to N-64.

42. The helmet as recited in claim 41, wherein said magnet component has a maximum energy product ($BH_{max}$) in the range of 35 to 64 MGO.

43. The headgear system as set forth in claim 11, wherein said magnet components emitting said magnetic forces of said first polarity radially outwardly from each of said helmets sufficient to reduce the impact force between said first and second helmets by an amount in the range of 11 to 37 G's compared to a helmet lacking said magnet components.

44. The headgear system as recited in claim 11, wherein said magnet components have a magnet strength equivalent to a neodymium magnet having a grade in the range of N-35 to N-64.

45. The headgear system as recited in claim 44, wherein said magnet components have a maximum energy product ($BH_{max}$) in the range of 35 to 64 MGO.

* * * * *